US011391525B2

(12) United States Patent
Yoon et al.

(10) Patent No.: US 11,391,525 B2
(45) Date of Patent: Jul. 19, 2022

(54) HEAT EXCHANGER FOR STEAM GENERATOR AND STEAM GENERATOR COMPRISING SAME

(71) Applicant: KOREA ATOMIC ENERGY RESEARCH INSTITUTE, Daejeon (KR)

(72) Inventors: Juhyeon Yoon, Daejeon (KR); Young In Kim, Daejeon (KR)

(73) Assignee: KOREA ATOMIC ENERGY RESEARCH INSTITUTE, Daejeon (KR)

( * ) Notice: Subject to any disclaimer, the term of this patent is extended or adjusted under 35 U.S.C. 154(b) by 93 days.

(21) Appl. No.: 16/669,727

(22) Filed: Oct. 31, 2019

(65) Prior Publication Data

US 2020/0072566 A1 Mar. 5, 2020

Related U.S. Application Data

(62) Division of application No. 15/026,938, filed as application No. PCT/KR2014/009118 on Sep. 29, 2014, now Pat. No. 10,488,123.

(30) Foreign Application Priority Data

Oct. 17, 2013 (KR) ..... 10-2013-0124182

(51) Int. Cl.
*F28F 13/00* (2006.01)
*F28F 13/06* (2006.01)
(Continued)

(52) U.S. Cl.
CPC ..... *F28F 13/06* (2013.01); *F28D 9/0037* (2013.01); *F28F 3/048* (2013.01); *F28F 9/026* (2013.01);
(Continued)

(58) Field of Classification Search
CPC . F28F 13/06; F28F 3/048; F28F 9/026; F28D 9/0037; F28D 9/026; F28D 2021/0064; F28D 2021/0085
(Continued)

(56) References Cited

U.S. PATENT DOCUMENTS 6,228,341 B1 * 5/2001 Hebert ..... F28D 9/0037 423/361
7,367,385 B1 * 5/2008 Materna ..... F28F 13/08 165/146
(Continued)

FOREIGN PATENT DOCUMENTS

JP 2001-133173 A 5/2001
KR 10-0938802 B1 1/2010
(Continued)

*Primary Examiner* — Claire E Rojohn, III
(74) *Attorney, Agent, or Firm* — Scully Scott Murphy and Presser

(57) ABSTRACT

A heat exchanger for a steam generator according to one embodiment of the present invention comprises a plate and channels formed on the plate by an photo-chemical etching method, wherein the channels comprise: a primary heat transmission section formed in a manner of having a bent or curved flow path so as to be extended longer than the length at which one side and the other side are connected in a straight line; and a flow path resistance section, formed having a smaller width than the width of the channels formed on the primary heat transmission section and being connected to the one side of the primary transmission section in a manner of having a bent or curved flow path so as to be extended longer than the length at which an inlet and an outlet are connected in a straight line.

7 Claims, 21 Drawing Sheets

(51) Int. Cl.

| | |
|---|---|
| ***F28F 3/04*** | (2006.01) |
| ***F28D 9/00*** | (2006.01) |
| ***F28F 9/02*** | (2006.01) |
| *F28D 21/00* | (2006.01) |

(52) U.S. Cl.
CPC ..... *F28D 2021/0064* (2013.01); *F28D 2021/0085* (2013.01)

(58) Field of Classification Search
USPC ..... 165/146, 170
See application file for complete search history.

(56) References Cited

U.S. PATENT DOCUMENTS 7,641,865 B2 * 1/2010 Tonkovich ..... F28F 13/06 422/504
2003/0152488 A1 * 8/2003 Tonkovich ..... B01F 25/431 428/137
2004/0013585 A1 * 1/2004 Whyatt ..... B01B 1/005 422/177
2005/0274501 A1 * 12/2005 Agee ..... F02M 26/22 165/146
2006/0090887 A1 * 5/2006 Kato ..... F28F 3/048 165/166
2006/0207754 A1 * 9/2006 Wisniewski ..... F28D 1/05366 165/146
2007/0225532 A1 * 9/2007 Tonkovich ..... C07C 15/46 422/198
2009/0211977 A1 8/2009 Miller
2009/0326279 A1 * 12/2009 Tonkovich ..... B01F 25/431 422/198
2010/0084120 A1 * 4/2010 Yin ..... F28D 9/0075 165/146
2010/0314088 A1 * 12/2010 Yoo ..... F28F 3/048 165/170
2011/0000624 A1 * 1/2011 Rops ..... F28D 9/0031 159/22
2012/0266599 A1 * 10/2012 Berger ..... F28F 13/08 62/515
2013/0042996 A1 * 2/2013 Hwang ..... F28D 9/0037 165/170
2014/0027102 A1 * 1/2014 Antel, Jr. ..... F28F 3/048 165/185
2017/0211893 A1 * 7/2017 Noishiki ..... F28D 9/0037
2018/0093242 A1 * 4/2018 Yano ..... C07C 1/041

FOREIGN PATENT DOCUMENTS

KR 10-2012-0011718 A 2/2012
KR 10-2013-0022738 A 3/2013

* cited by examiner

HEAT EXCHANGER FOR STEAM GENERATOR AND STEAM GENERATOR COMPRISING SAME

CROSS REFERENCE TO RELATED APPLICATIONS

This application is a divisional application of U.S. application Ser. No. 15/026,938 filed on Apr. 1, 2016, which is a National Stage Entry of Application No. of PCT/KR2014/009118 filed on Sep. 29, 2014, which claims the benefit of priority from K.R. Provisional Application No. 10-2013-0124182, filed on Oct. 17, 2013.

TECHNICAL FIELD

These embodiments relate to a technology for utilizing a printed circuit heat exchanger, a plate type heat exchanger or the like as a steam generator for stably producing steam, namely, relates to a printed circuit steam generator or a plate type steam generator.

BACKGROUND ART

A printed circuit heat exchanger has been developed by the Heatric Ltd. in UK, and very variously used in general industrial fields. The printed circuit heat exchanger is a heat exchanger having a structure in which welding between plates of the heat exchanger is avoided using a dense arrangement of channels by a photo-chemical etching technique and diffusion bonding. Accordingly, the printed circuit heat exchanger is applicable to high-temperature and high-pressure environments and has a high-density and excellent heat exchange performance. The advantages of the printed circuit heat exchanger, such as durability against the high-temperature and high-pressure environments, the high-density and the excellent heat exchange efficiency, extend an application range of the printed circuit heat exchanger to various fields, such as an evaporator, a condenser, a cooler, a radiator, a heat exchanger, a reactor, and the like, involved in an air conditioning, a fuel cell, a vehicle, a chemical process, a medical instrument, atomic energy, a nuclear power plant, a communication device, a very low temperature environment and the like.

The plate type heat exchanger is widely applied in industrial fields over one hundred years. The plate type heat exchanger is generally configured such that plates are pressed out to form channels and then coupled using gaskets or by typical molding or brazing. Accordingly, the plate type heat exchanger is similar to the printed circuit heat exchanger in view of an application field, but is more widely used under a low-pressure environment. Heat exchange efficiency of the plate type heat exchanger is lower than that of the printed circuit heat exchanger but higher than that of a shell and tube heat exchanger. Also, the plate type heat exchanger is manufactured through more simplified processes than the printed circuit heat exchanger.

However, in the applications involving two phase flow such as evaporators, the printed circuit and plate type heat exchangers have been used within limited operating conditions. The printed circuit heat exchanger or plate type heat exchanger has not been widely used as a steam generator, due to flow instabilities in channels, although it exhibits much higher heat transfer efficiency than other types of heat exchangers, such as the shell and tube type heat exchanger and the like.

Therefore, a heat exchanger which is capable of generating steam stably in various operation ranges as well as solving flow instabilities in flow channels may be taken into account.

DISCLOSURE OF THE INVENTION

Therefore, an aspect of the detailed description is to provide a heat exchanger capable of being used as a steam generator.

Another aspect of the detailed description is to provide a heat exchanger capable of generating steam more stably with an improved structure.

To achieve these and other advantages and in accordance with the purpose of the present invention, as embodied and broadly described herein, there is provided a heat exchanger for a steam generator, the heat exchanger including a plate, and channels formed on the plate, wherein each of the channels includes a primary heat transmission section including a bent or curved flow path to extend longer than a distance between one side and another side, and a flow resistance section formed having a smaller width than the width of the channels formed on the primary heat transmission section, and connected to one side of the primary heat transmission section in a manner of having a bent or curved flow path to extend longer than a distance between an inlet and an outlet.

In accordance with one embodiment of the present invention, the heat exchanger may further include a flow path expanding section formed between the flow resistance section and the primary heat transmission section in a manner of having a gradually increasing width.

In accordance with one embodiment of the present invention, the flow resistance section may further include a bent or curved flow path for an increased flow resistance of the flow resistance section.

In accordance with one embodiment of the present invention, the flow resistance section may include first parts extending in a first direction as a direction connecting the inlet and the outlet to each other, and second parts extending in a second direction intersecting with the first direction. The first and second parts may be formed in an alternating manner.

In accordance with one embodiment of the present invention, the flow resistance section may further include a flow path region of sudden expansion or sudden contraction for an increased flow resistance of the flow resistance section.

In accordance with one embodiment of the present invention, one of the first and second parts may be connected to an edge of the other.

In accordance with one embodiment of the present invention, one of the first and second parts may be connected to a portion between both ends of the other.

In accordance with one embodiment of the present invention, the flow resistance section may be configured such that a forward path coming from the inlet toward the outlet has smaller flow resistance than that of a backward path coming from the outlet toward the inlet.

In accordance with one embodiment of the present invention, the flow resistance section may include first and second tilt portions connecting the inlet and the outlet, and a bypass portion formed in a manner that the backward path has greater flow resistance.

In accordance with one embodiment of the present invention, the bypass portion may be configured to extend from one end of one of the tilt portions to a portion between both ends of the other tilt portion so as to be getting away from the outlet.

In accordance with one embodiment of the present invention, the primary heat transmission section may include a first area in which fluid in a liquid state exists, a second area in which fluid in liquid and gaseous states exists, and a third area in which fluid in a gaseous state exists. At least one of channels of the first to third areas may be connected in a communicating manner.

In accordance with one embodiment of the present invention, the heat exchanger may further include a common header connected to inlets of the flow resistance section.

A heat exchanger for a steam generator according to another embodiment of the present invention, to achieve these and other advantages may include first to third plates overlaid on one another, and channels formed on the plates, respectively, wherein each of the channels includes a primary heat transmission section having a bent or curved flow path to extend longer than a distance between one side and another side, wherein the second plate includes a flow resistance section that is formed having a smaller width than the width of the channels of the primary heat transmission section, and connected to one side of the primary heat transmission section in a manner of having a bent or curved flow path to extend longer than a distance between an inlet and an outlet.

In accordance with one embodiment of the present invention, a first fluid may be introduced and discharged through the channels of the first plate, and a second fluid may be introduced and discharged through the channels of the second and third plates.

In accordance with one embodiment of the present invention, in the overlaid state of the second and third plates, the primary heat transmission section of the third plate may form an upper portion of a second channel, the primary heat transmission section of the second plate may form a lower portion of the second channel, and the first plate may form a channel with at least one plate.

In accordance with one embodiment of the present invention, the second plate may further include a lower flow path expanding section formed between the flow resistance section and the primary heat transmission section in a manner of having a gradually increasing width.

In accordance with one embodiment of the present invention, the third plate may further include an upper flow path expanding section formed at a position corresponding to the lower flow path expanding section.

In accordance with one embodiment of the present invention, the flow resistance section may further include a bent or curved flow path for an increased flow resistance of the flow resistance section.

In accordance with one embodiment of the present invention, the flow resistance section may include first parts extending in a first direction as a direction connecting the inlet and the outlet to each other, and second parts extending in a second direction intersecting with the first direction. The first and second parts may be formed in an alternating manner.

In accordance with one embodiment of the present invention, the flow resistance section may further include a flow path region of sudden expansion or sudden contraction, in order to increase flow resistance of the flow resistance section.

In accordance with one embodiment of the present invention, one of the first and second parts may be connected to an edge of the other.

In accordance with one embodiment of the present invention, one of the first and second parts may be connected to a portion between both ends of the other.

In accordance with one embodiment of the present invention, the flow resistance section may be configured such that a forward path coming from the inlet toward the outlet has smaller flow resistance than that of a backward path coming from the outlet toward the inlet.

In accordance with one embodiment of the present invention, the flow resistance section may include first and second tilt portions connecting the inlet and the outlet, and a bypass portion formed in a manner that the backward path has greater flow resistance.

In accordance with one embodiment of the present invention, the bypass portion may be configured to extend from one end of one of the tilt portions to a portion between both ends of the other tilt portion so as to be getting away from the outlet.

Advantageous Effect

In accordance with the detailed description, a heat exchanger for a steam generator according to at least one embodiment of the present invention with the configuration can increase flow resistance in a flow resistance section, which may enable more stable production of steam and therefore expand a lifespan of the heat exchanger for the steam generator.

Also, a wider flow path area can be applied to the steam generator, which may result in reducing contamination of the flow path.

And, with the use of simply switching flow paths, the heat exchanger for the steam generator according to the present invention can be applied to the related art heat exchanger for the steam generator. Also, the heat exchanger for the steam generator can be fabricated into a more compact size, and welded portions can be removed from primary heat transmission section.

MODES FOR CARRYING OUT THE PREFERRED EMBODIMENTS

Description will now be given in detail of a heat exchanger for a steam generator according to exemplary embodiments disclosed herein, with reference to the accompanying drawings. A suffix "module" or "unit" used for constituent elements disclosed in the following description is merely intended for easy description of the specification, and the suffix itself does not give any special meaning or function. For the sake of brief description with reference to the drawings, the same or equivalent components will be provided with the same reference numbers, and description thereof will not be repeated. A singular representation may include a plural representation unless it represents a definitely different meaning from the context.

A steam generator turns (converts) secondary water into steam using heat of primary water, supplies the steam to a turbine, and rotates the turbine using the supplied steam to generate electric power. A plurality of heat exchangers is disposed in the steam generator. And, when a first fluid passes through a first plate of a heat exchanger, a second fluid passing through a second plate is converted into steam by heat transferred to the second plate which is disposed adjacent to the first plate.

Figure 1:
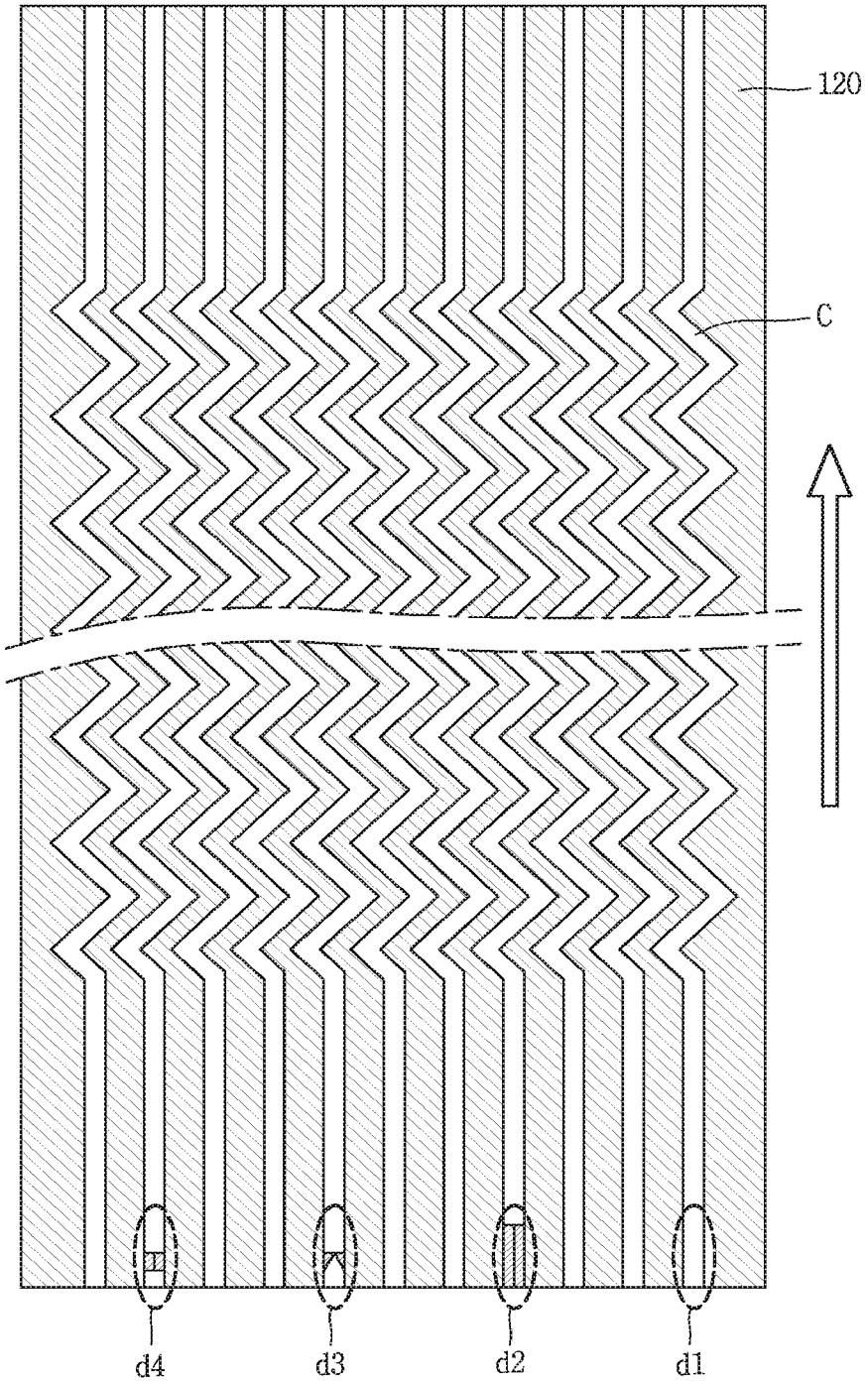
FIG. 1 is a conceptual view of channels formed on a second plate of the related art heat exchanger.
Figure 2:
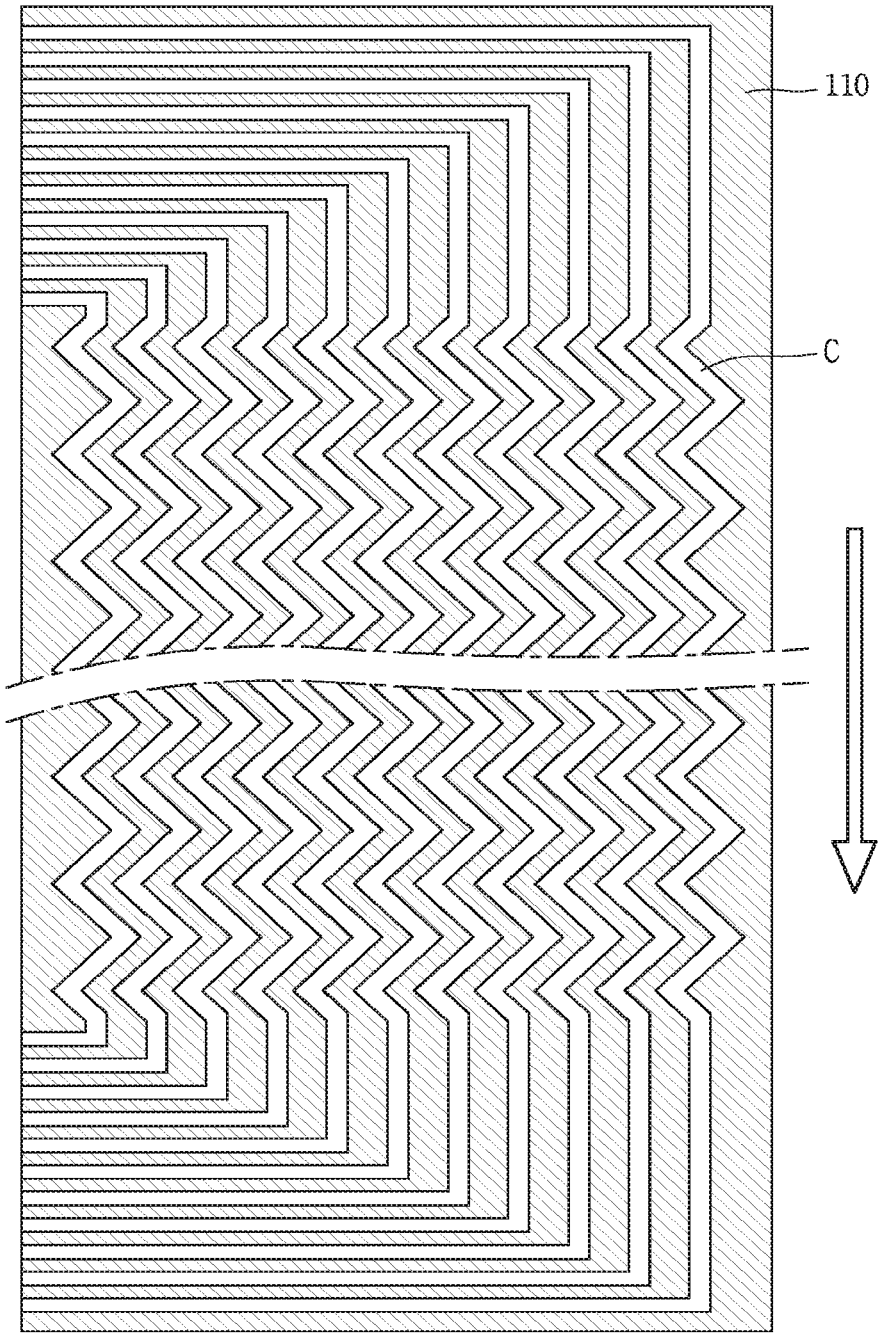
FIG. 2 is a conceptual view of channels formed on a first plate of the related art heat exchanger.

FIG. 1 is a conceptual view of channels C formed on a second plate 120 of the related art heat exchanger, and FIG. 2 is a conceptual view of channels C formed on a first plate of the related art heat exchanger.

As illustrated in FIGS. 1 and 2, when a first coolant flows through the channels C formed on the first plate 110, heat is transferred to the second plate 120. The transferred heat may heat a second coolant which flows along the second plate 120, thereby producing steam.

In this process, generally in heat exchangers involving two phase flow within flow channels, flow instabilities may occur if the flow path (d1 in FIG. 1) is used, due to the pressure wave propagation, which stems from a rapid increase in volume and decrease in density by steam generation. Accordingly, pressure waves are propagated forward and backward in a flow path direction. The pressure drop difference which is initiated from a discrepancy of the phase change location causes an unstable flow, and this increases the flow instability. Especially, for a steam generator having a plurality of flow channels connected to a common header, the instability becomes more stronger by the feedback effect of the phase change mismatch between the multi-channels (parallel channel oscillation), and a function as a steam generator could be lost. This is specifically an important issue for the steam generators with a wide range operation mode such as a startup and a low level power operation.

To reduce such effects a shell and tube type steam generator with a wide general operation range applies an orifice with high flow resistance at the inlet of the secondary tube.

As illustrated in FIG. 1, the related art technology (d2 to d4) simply reducing a flow path area may cause problems, such as flow path fouling, clogging, blocking and the like, and thus may be restricted from being applied to applications requiring for a long-term lifespan, such as a nuclear power environment. In the present invention, contamination of a flow path refers to an effect that various types of impurities, which are accumulated due to a long-term use of the steam generator, reduce or block a cross section of a flow path. As a result, this affects a flow rate of water. This problem may be accelerated as an inlet flow path cross section is more reduced.

The first plate and the second plate may be installed at positions where inlets or outlets thereof do not overlap each other, and thus the present invention may not be limited to the configuration of the printed circuit flow path as illustrated in FIG. 1 or 2.

Hereinafter, a heat exchanger or a heat exchanger for a steam generator disclosed herein, unless especially mentioned, generally refers to the general plate type and printed circuit heat exchangers, and also even a case of employing a different processing or bonding method for plates.

FIGS. 3 to 7 are conceptual views of channels formed on a second plate of a heat exchanger for a steam generator in accordance with embodiments of the present invention.

While a second fluid flows through the second plate 220, 320, 420, 520, 620, phase transition from liquid to gas occurs, thereby generating steam. The second plate 220, 320, 420, 520, 620 may include a plurality of channels C, which may have widths in the range of one meter (m) to several millimeters (mm).

Each of the channels C may divided into a primary heat transmission section 221, 321, 421, 521, 621 and a flow resistance section 222, 322, 422, 522, 622. The channel C of the primary heat transmission section 221, 321, 421, 521, 621 may be bent so as to extend longer than a distance between one side 221*a*, 321*a*, 421*a*, 521*a*, 621*a* and another side 221*b*, 321*b*, 421*b*, 521*b*, 621*b* (a length at which one side 221*a*, 321*a*, 421*a*, 521*a*, 621*a* and another side 221*b*, 321*b*, 421*b*, 521*b*, 621*b* are connected in a straight line). This may extend the length of each channel C than the straightly-connected length, which may greatly increase a heat exchange area and improve heat exchanger efficiency accordingly. The embodiment disclosed herein merely illustrates the bent shape, but the present invention may not be necessarily limited to the flow path in the bent shape because a similar effect can be obtained even in case of using a curved flow path.

Each of the channels of the flow resistance section 222, 322, 422, 522, 622 may have a width smaller than the width of the channel formed on the primary heat transmission section 221, 321, 421, 521, 621, and may be bent so as to extend longer than a distance between one side 222*a*, 322*a*, 422*a*, 522*a*, 622*a* and another side 222*b*, 322*b*, 422*b*, 522*b*, 622*b* (a length at which one side 222*a*, 322*a*, 422*a*, 522*a*, 622*a* and another side 222*b*, 322*b*, 422*b*, 522*b*, 622*b* are connected in a straight line). The flow resistance section 222, 322, 422, 522, 622 may be connected to one side corresponding to an inlet of the primary heat transmission section 221, 321, 421, 521, 621. The flow resistance section 222, 322, 422, 522, 622 may be provided with longer and narrower channels at the inlet area, resulting in greater flow resistance and thus reduced flow instability in each channel within a wide operation range. Accordingly, the steam generator can operate in a stable state. The embodiment disclosed herein merely illustrates the bent shape, but the present invention may not be necessarily limited to the bent shape because a similar effect can be obtained even in case of using a curved flow path.

A flow path expanding section 223, 323, 423, 523, 623 may be formed between the flow resistance section 222, 322, 422, 522, 622 and the primary heat transmission section 221,

321, 421, 521, 621. The flow path expanding section 223, 323, 423, 523, 623 may have a width which gradually increases, thereby preventing a drastic change in the coolant flow.

Figure 3:
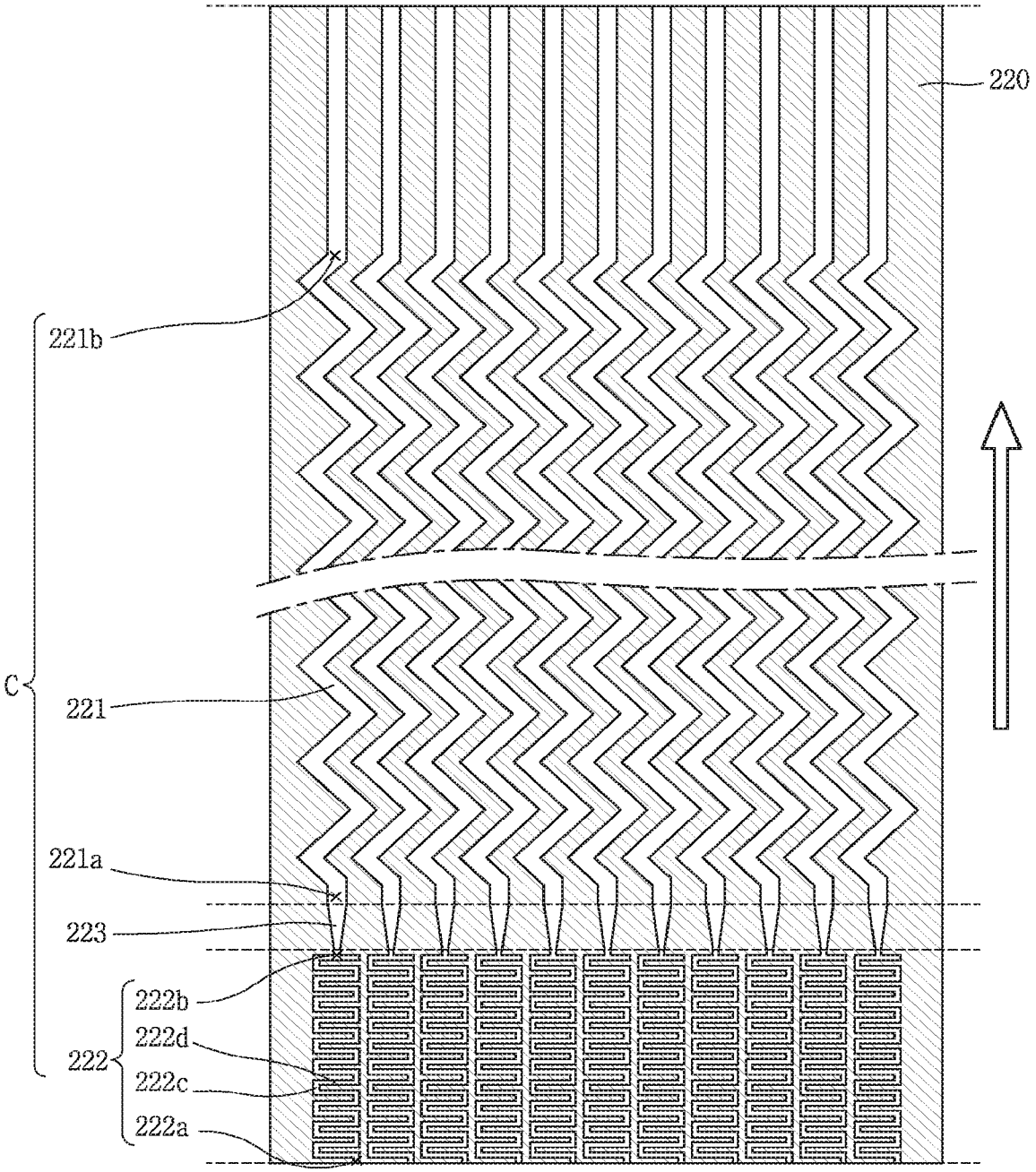
FIGS. 3 to 7 are conceptual views of channels formed on a second plate of a heat exchanger for a steam generator in accordance with embodiments of the present invention.
Figure 4:
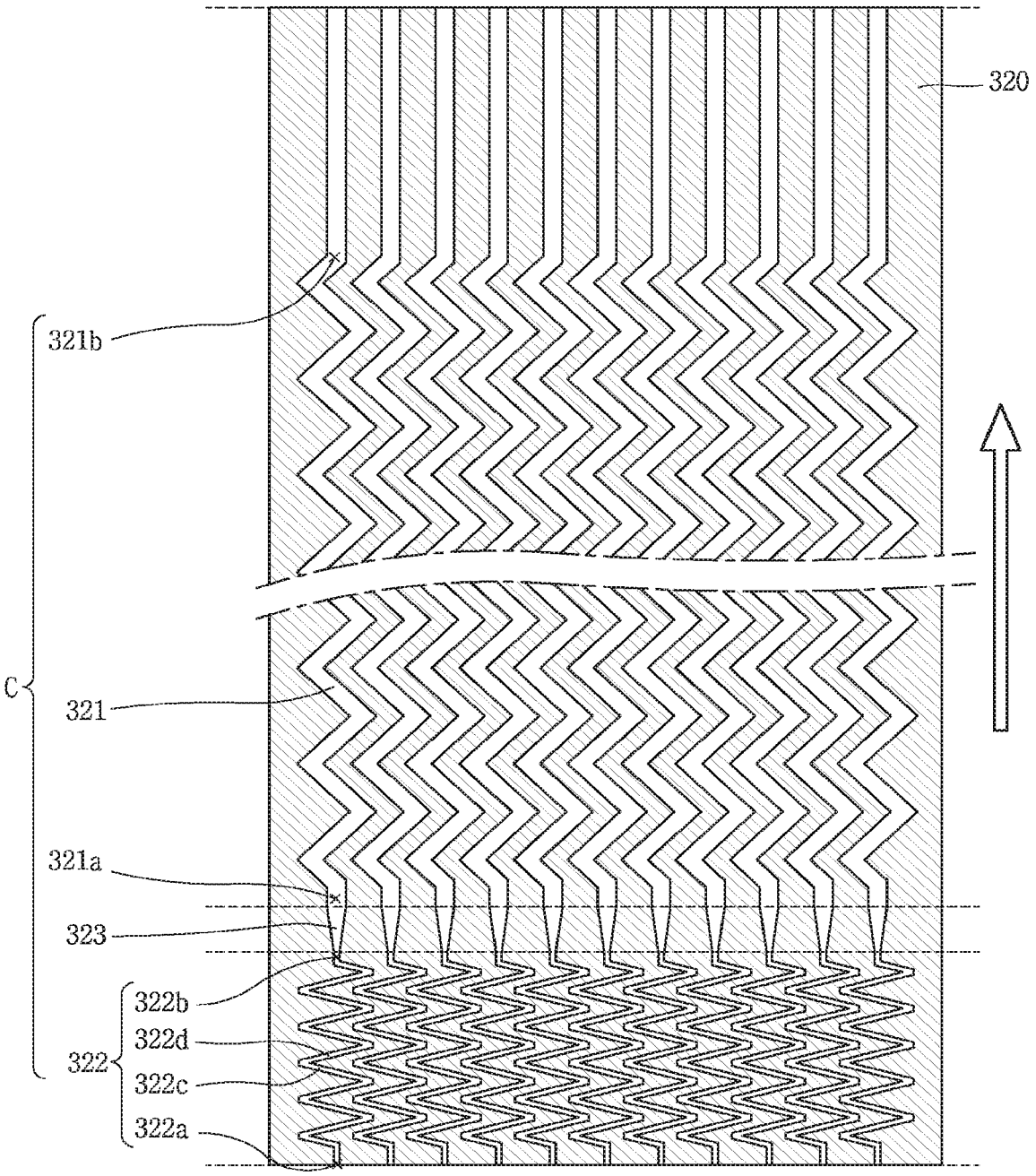

FIGS. 3 and 4 illustrate exemplary configurations according to the present invention which employ flow path structures reducing a flow path area and increasing a flow path length, respectively, in order to increase flow resistance of the flow resistance sections 222, 322, but the present invention may not be necessarily limited to these configurations.

Referring to FIG. 3, the flow resistance section 222 includes first (primary) parts 222*c* and second (secondary) parts 222*d*. The first parts 222*c* are portions extending in a first (primary) direction which is a direction connecting an inlet and an outlet, and the second parts 222*d* are portions extending in a second (secondary) direction which intersects with the first direction. The first parts 222*c* and the second parts 222*d* may be formed in an alternating manner. One of the first and second parts 222*c* and 222*d* may be connected to an edge of the other.

Referring to FIG. 4, the flow resistance section 322 includes first tilt portions 322*c* and second tilt portions 322*d*. The first tilt portion 322*c* and the second tilt portion 322*d* may be connected with each other at one end.

Figure 5:
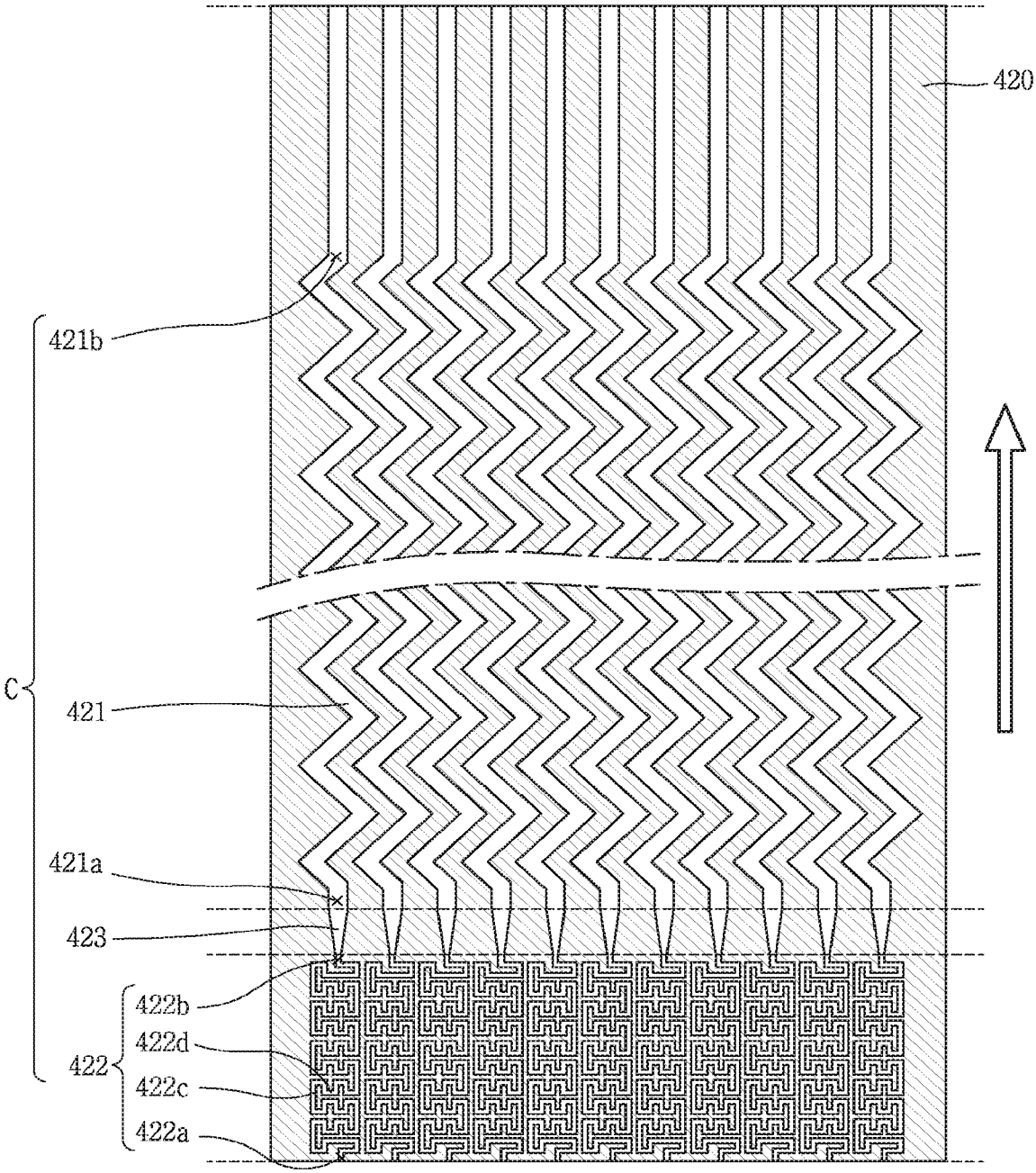
Figure 6:
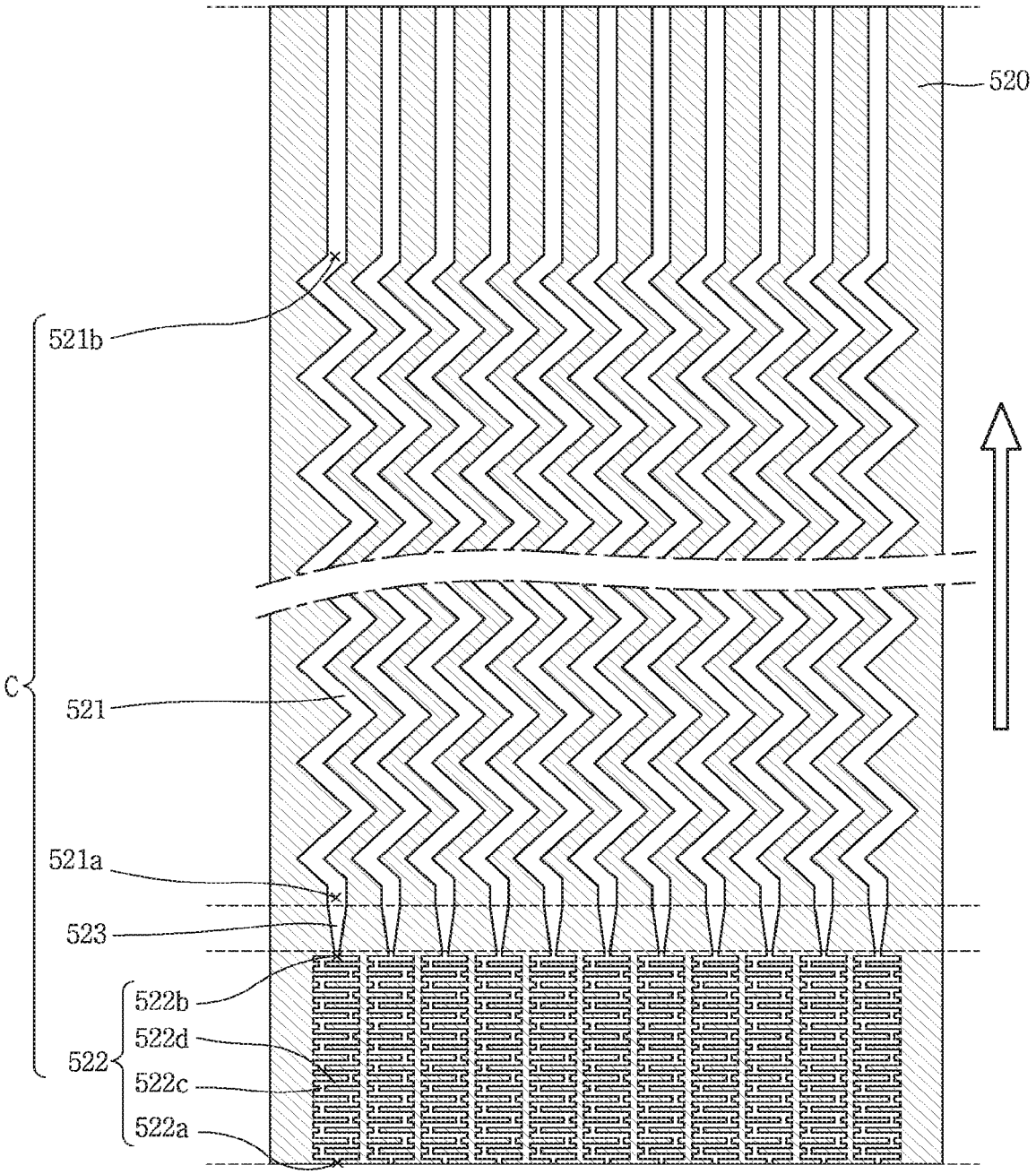

FIGS. 5 and 6 illustrate exemplary configurations according to the present invention which employ different flow path structures from those illustrated in FIGS. 3 and 4, respectively, in order to increase flow resistance of the flow resistance sections 422 and 522, but the present invention may not be necessarily limited to this configuration.

Referring to FIG. 5, the flow resistance section 422 includes first parts 422*c* and second parts 422*d*. The first parts 422*c* are portions extending in a first direction which is a direction connecting an inlet and an outlet, and the second parts 422*d* are portions extending in a second direction that intersects with the first direction. The first parts 422*c* and the second parts 422*d* may be formed in an alternating manner. One of the first and second parts 422*c* and 422*d* may be connected to an edge of the other. The first parts 422*c* and the second parts 422*d* have different lengths and more bent portions, respectively, unlike those illustrated in FIG. 3. This may increase the flow resistance further.

Referring to FIG. 6, the flow resistance section 522 includes first parts 522*c* and second parts 522*d*. The first parts 522*c* are portions extending in a first direction which is a direction connecting an inlet and an outlet, and the second parts 522*d* are portions extending in a second direction that intersects with the first direction. The first parts 522*c* and the second parts 522*d* may be formed in an alternating manner. One of the first and second parts 522*c* and 522*d* is connected to a portion between both ends of the other. The first and second parts 522*c* and 522*d*, unlike those illustrated in FIG. 3, may have different lengths, respectively, and also include a flow path region of sudden expansion or sudden contraction, so as to have a shape causing greater flow resistance. This may result in an increased the flow resistance.

Figure 7:
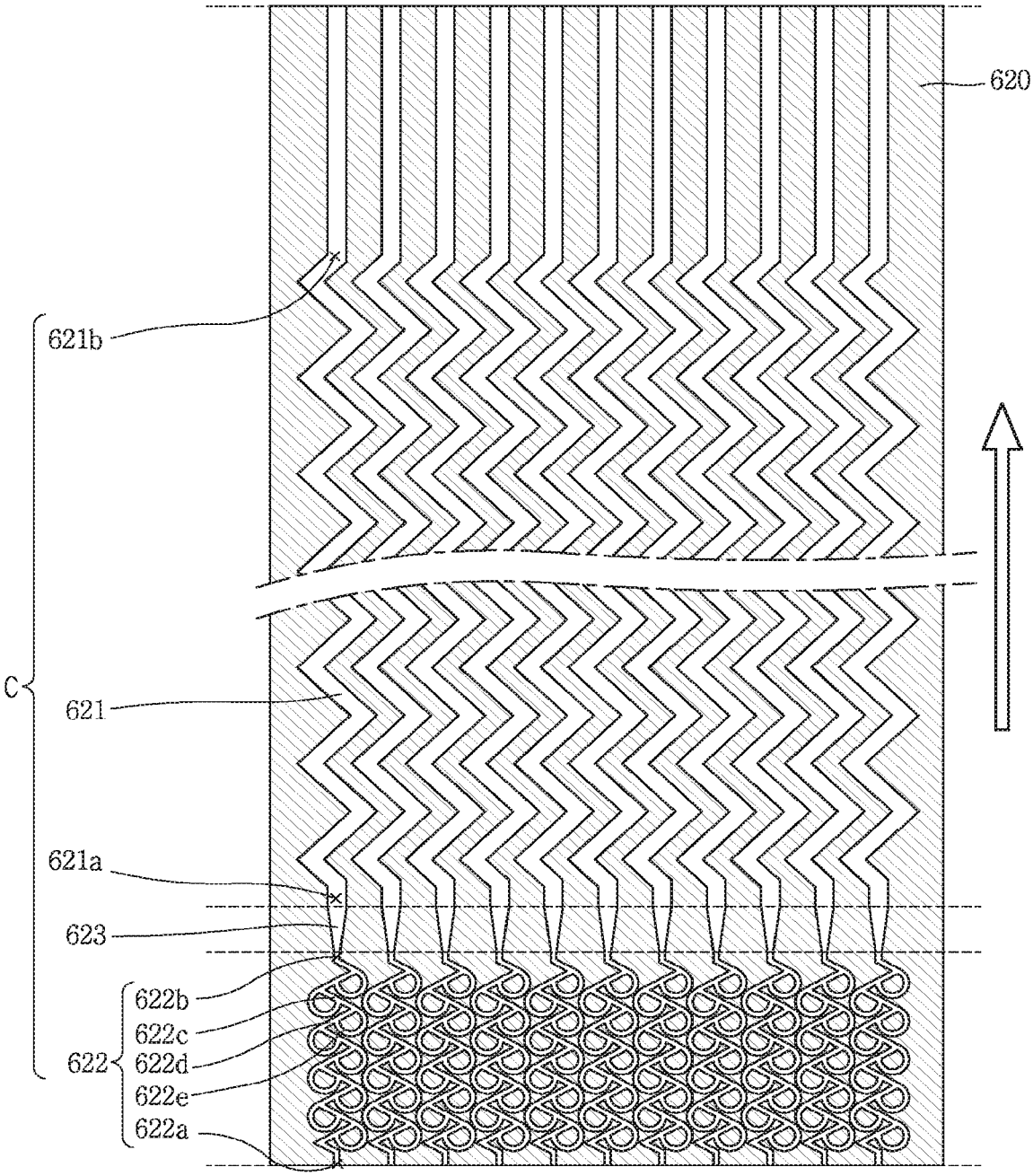

FIG. 7 illustrates an exemplary configuration according to the present invention in which different flow path structures are applied in a forward direction and a backward direction in order to increase backward flow resistance of the flow resistance section 622, but the present invention may not be limited to this configuration.

Referring to FIG. 7, the flow resistance section 622 includes first tilt portions 622*c* and second tilt portions 622*d*. Here, the flow resistance section 622 is configured such that a forward path coming from an inlet to an outlet has smaller flow resistance than a backward path coming from the outlet to the inlet. Accordingly, the backward flow resistance may become greater than the forward flow resistance.

To achieve this, a bypass portion 622*e* is provided in which the backward path has greater flow resistance. The bypass portion 622*e* connects an edge of one of the tilt portions to a portion between both ends of the other tilt portion so as to be getting away from an outlet.

FIGS. 8 to 12 are conceptual views of channels formed on a second plate of a heat exchanger for a steam generator in accordance in accordance with embodiments of the present invention. In such case, the channels may be formed on the first plate by switching a flowing direction to be opposite to the flowing direction of FIG. 1 (d1).

The second plate 1220, 1320, 1420, 1520, 1620 may include a plurality of channels C, which have widths in the range of 1 m to several millimeters (mm).

Each of the channels C formed on the second plate 1220, 1320, 1420, 1520, 1620 may be divided into a primary heat transmission section 1221, 1321, 1421, 1521, 1621 and a flow resistance section 1222, 1322, 1422, 1522, 1622. Each of the channels C of the primary heat transmission sections 1221, 1321, 1421, 1521, 1621 may be bent so as to extend longer than a distance between one side 1221*a*, 1321*a*, 1421*a*, 1521*a*, 1621*a* and another side 1221*b*, 1321*b*, 1421*b*, 1521*b*, 1621*b* (a length at which one side 1221*a*, 1321*a*, 1421*a*, 1521*a*, 1621*a* and another side 1221*b*, 1321*b*, 1421*b*, 1521*b*, 1621*b* are connected in a straight line). This may extend channel length, which may increase the heat exchange area and improve heat exchanger efficiency accordingly. The embodiment disclosed herein merely illustrates the bent shape, but the present invention may not be necessarily limited to the flow path in the bent shape because a similar effect can be obtained even in case of using a curved flow path.

Each of the channels of the flow resistance section 1222, 1322, 1422, 1522, 1622 may have a width smaller than a channel formed on the primary heat transmission section 1221, 1321, 1421, 1521, 1621, and may be bent so as to extend longer than a distance between one side 1222*a*, 1322*a*, 1422*a*, 1522*a*, 1622*a* and another side 1222*b*, 1322*b*, 1422*b*, 1522*b*, 1622*b* (a length at which one side 1222*a*, 1322*a*, 1422*a*, 1522*a*, 1622*a* and another side 1222*b*, 1322*b*, 1422*b*, 1522*b*, 1622*b* are connected in a straight line). The flow resistance section 1222, 1322, 1422, 1522, 1622 may be connected to one side corresponding to an inlet of the primary heat transmission section 1221, 1321, 1421, 1521, 1621. The flow resistance section 1222, 1322, 1422, 1522, 1622 may form channels, which are longer in length and smaller in width, at the inlet area of the heat exchanger. This may result in greater flow resistance and thus reduced flow instability in each channel within a wide operation range. Accordingly, the steam generator can operate in a stable state. The embodiment disclosed herein merely illustrates the bent shape, but the present invention may not be necessarily limited to the bent shape because a similar effect can be obtained even in case of using a curved flow path.

A flow path expanding section 1223, 1323, 1423, 1523, 1623 may be formed between the flow resistance section 1222, 1322, 1422, 1522, 1622 and the primary heat transmission section 1221, 1321, 1421, 1521, 1621.

The flow path expanding section 1223, 1323, 1423, 1523, 1623 may have a width which gradually increases, thereby preventing a drastic change in the coolant flow.

Also, a common header 1224, 1324, 1424, 1524, 1624 may be formed at an inlet of the flow resistance section 1222, 1322, 1422, 1522, 1622. A second fluid supplied through the common header 1224, 1324, 1424, 1524, 1624 is distributed into the channels C of the second plate 1220, 1320, 1420, 1520, 1620, respectively.

Figure 8:
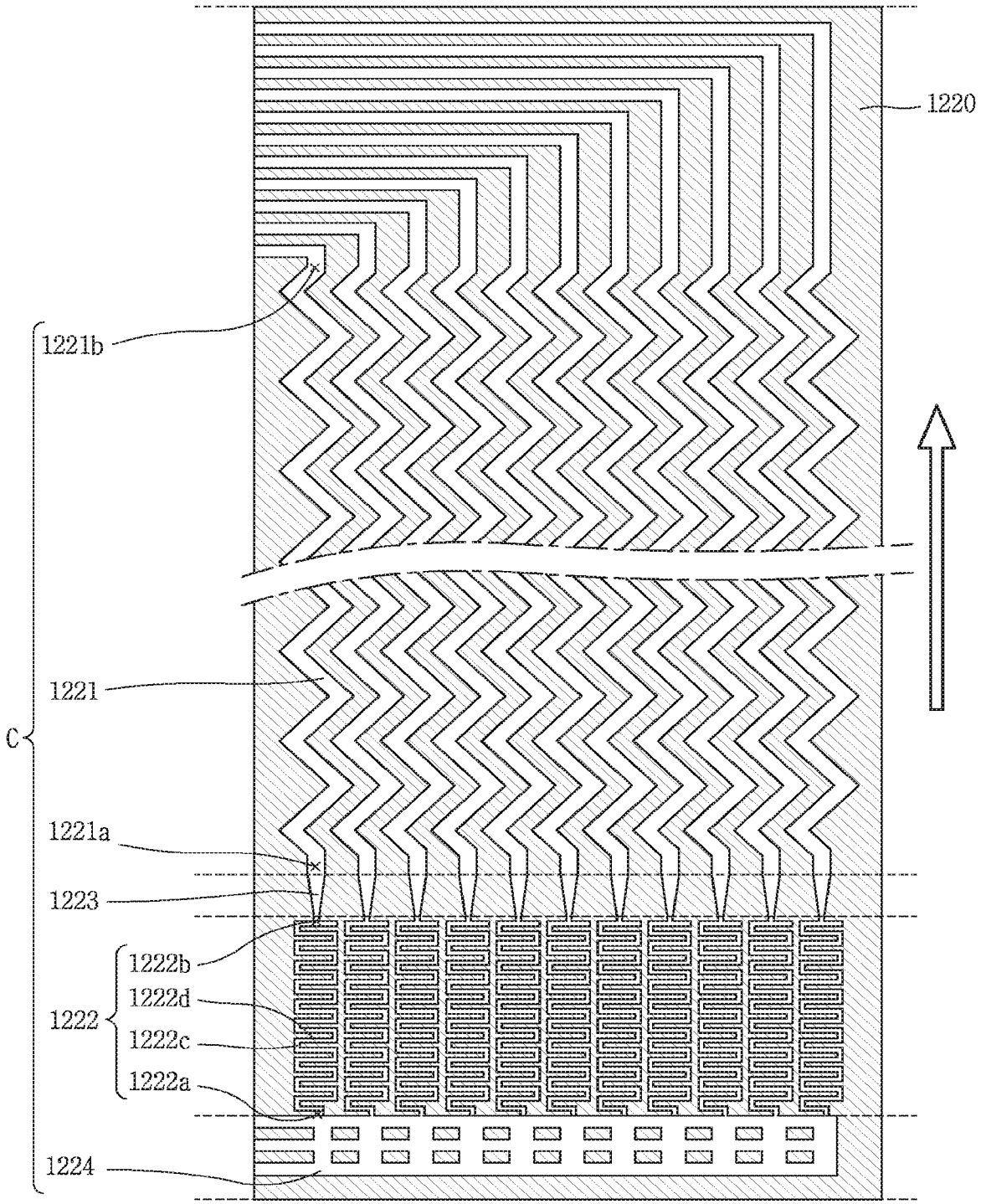
FIGS. 8 to 12 are conceptual views of channels formed on a second plate of a heat exchanger for a steam generator in accordance with embodiments of the present invention.
Figure 9:
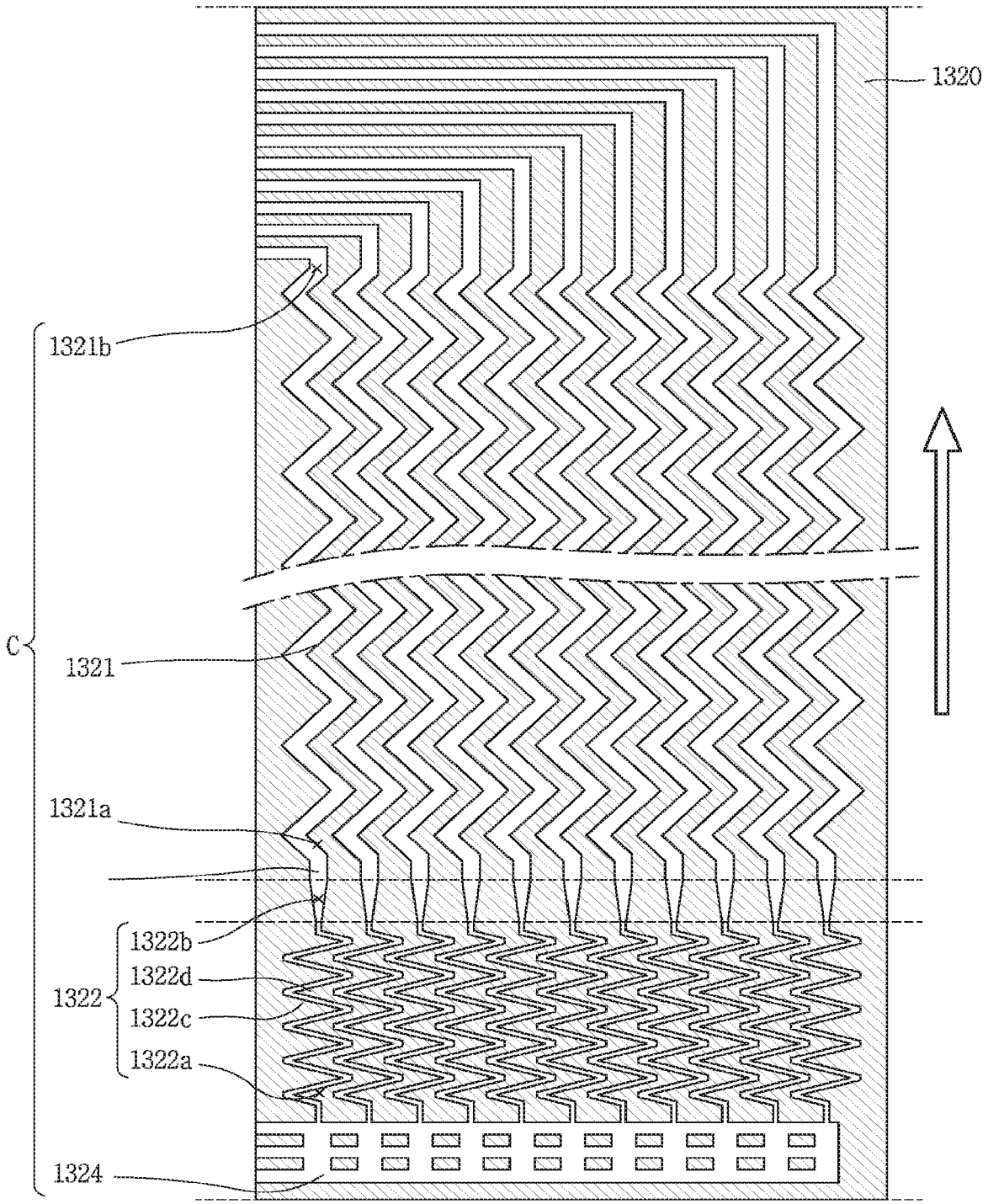

FIGS. 8 and 9 illustrate exemplary configurations according to the present invention employing flow path structures of reducing a flow path area and increasing a flow path length, in order to increase flow resistance of the flow resistance sections 1222, 1322, but the present invention may not be necessarily limited to these configurations.

Referring to FIG. 8, the flow resistance section 1222 includes first parts 1222*c* and second parts 1222*d*. The first parts 1222*c* are portions extending in a first direction which is a direction connecting an inlet and an outlet, and the second parts 1222*d* are portions extending in a second direction which intersects with the first direction. The first parts 1222*c* and the second parts 1222*d* may be formed in an alternating manner. One of the first and second parts 1222*c* and 1222*d* may be connected to an edge of the other.

Referring to FIG. 9, the flow resistance section 1322 includes first tilt portions 1322*c* and second tilt portions 1322*d*. The first tilt portion 1322*c* and the second tilt portion 1322*d* may be connected with each other at one end.

Figure 10:
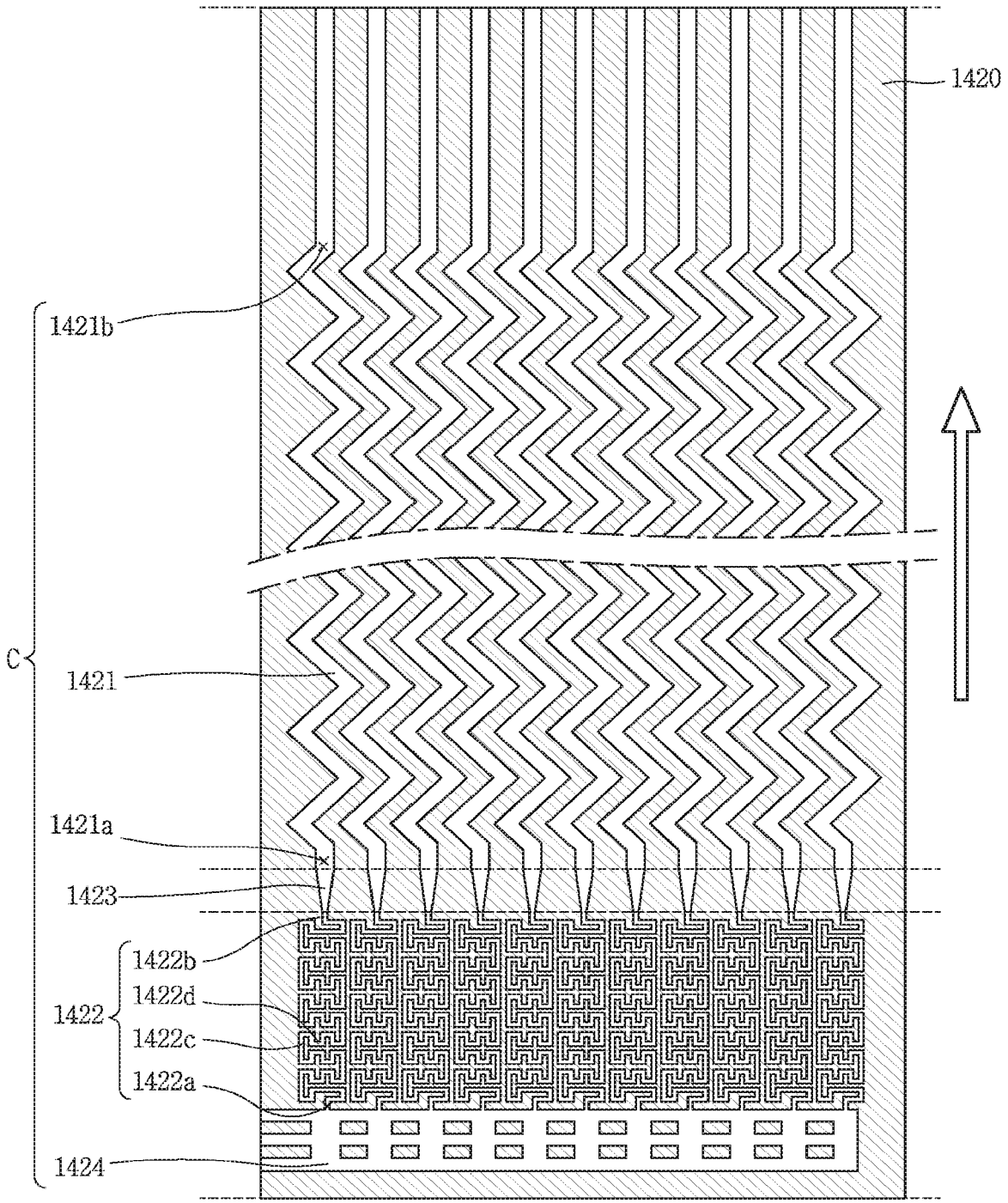
Figure 11:
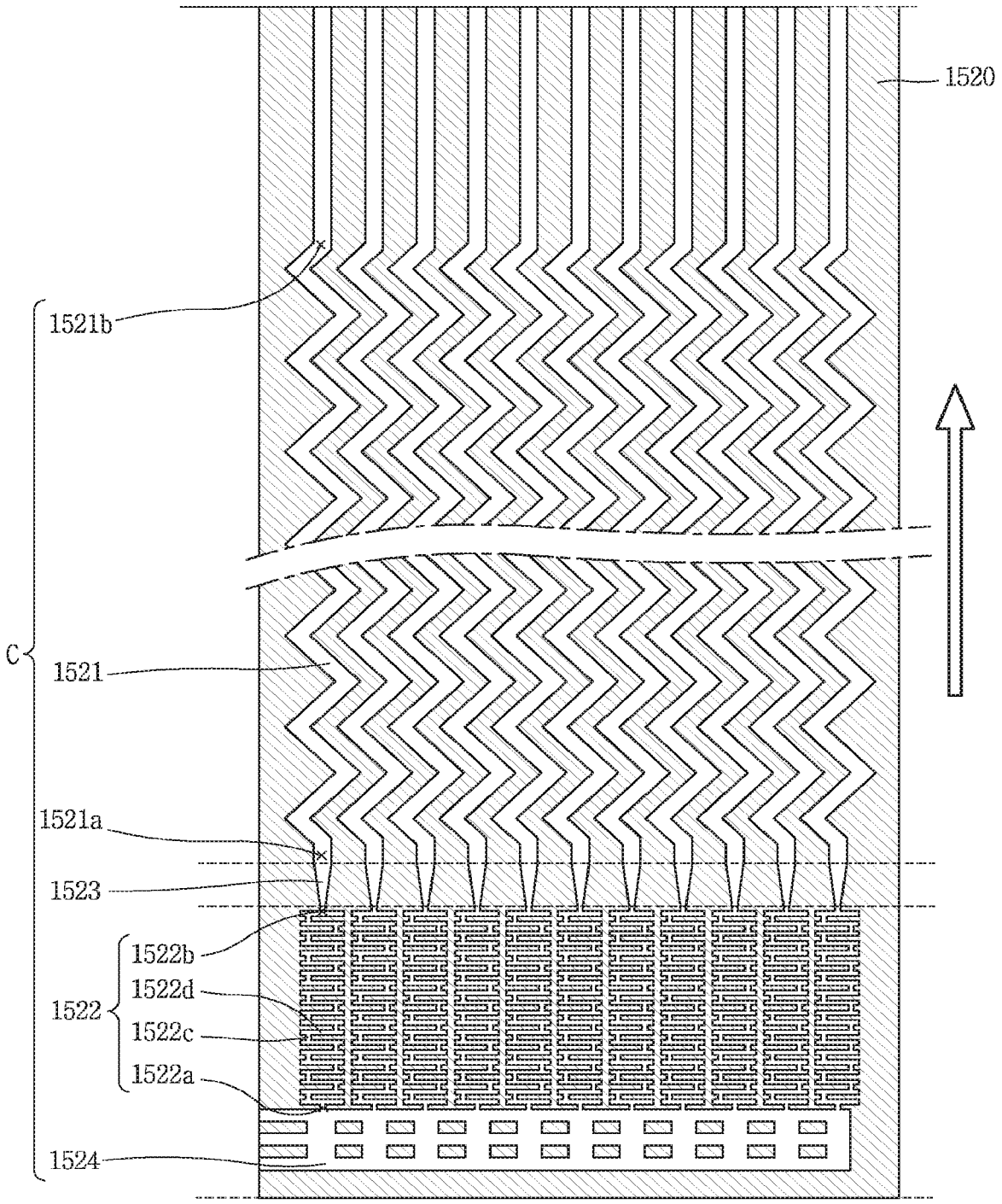

FIGS. 10 and 11 illustrate exemplary configurations according to the present invention which employs different flow path structures from those illustrated in FIGS. 8 and 9, in order to increase flow resistance of the flow resistance sections 1422 and 1522, but the present invention may not be necessarily limited to this configuration.

Referring to FIG. 10, the flow resistance section 1422 includes first parts 1422*c* and second parts 1422*d*. The first parts 1422*c* are portions extending in a first direction which is a direction connecting an inlet and an outlet, and the second parts 1422*d* are portions extending in a second direction that intersects with the first direction. The first parts 1422*c* and the second parts 1422*d* may be formed in an alternating manner. One of the first and second parts 1422*c* and 1422*d* may be connected to an edge of the other. The first and second parts 1422*c* and 1422*d*, unlike those illustrated in FIG. 3, have different shapes and more bent portions, respectively. This may increase the flow resistance further.

Referring to FIG. 11, the flow resistance section 1522 includes first parts 1522*c* and second parts 1522*d*. The first parts 522*c* are portions extending in a first direction which is a direction connecting an inlet and an outlet, and the second parts 1522*d* are portions extending in a second direction that intersects with the first direction. The first parts 1522*c* and the second parts 1522*d* may be formed in an alternating manner. One of the first and second parts 1522*c* and 1522*d* is connected to a portion between both side ends of the other. The first and second parts 1522*c* and 1522*d*, unlike those illustrated in FIG. 3, may have different lengths, respectively, and also include a flow path region of sudden expansion or sudden contraction, so as to have a shape causing greater flow resistance. This may result in an increased the flow resistance.

Figure 12:
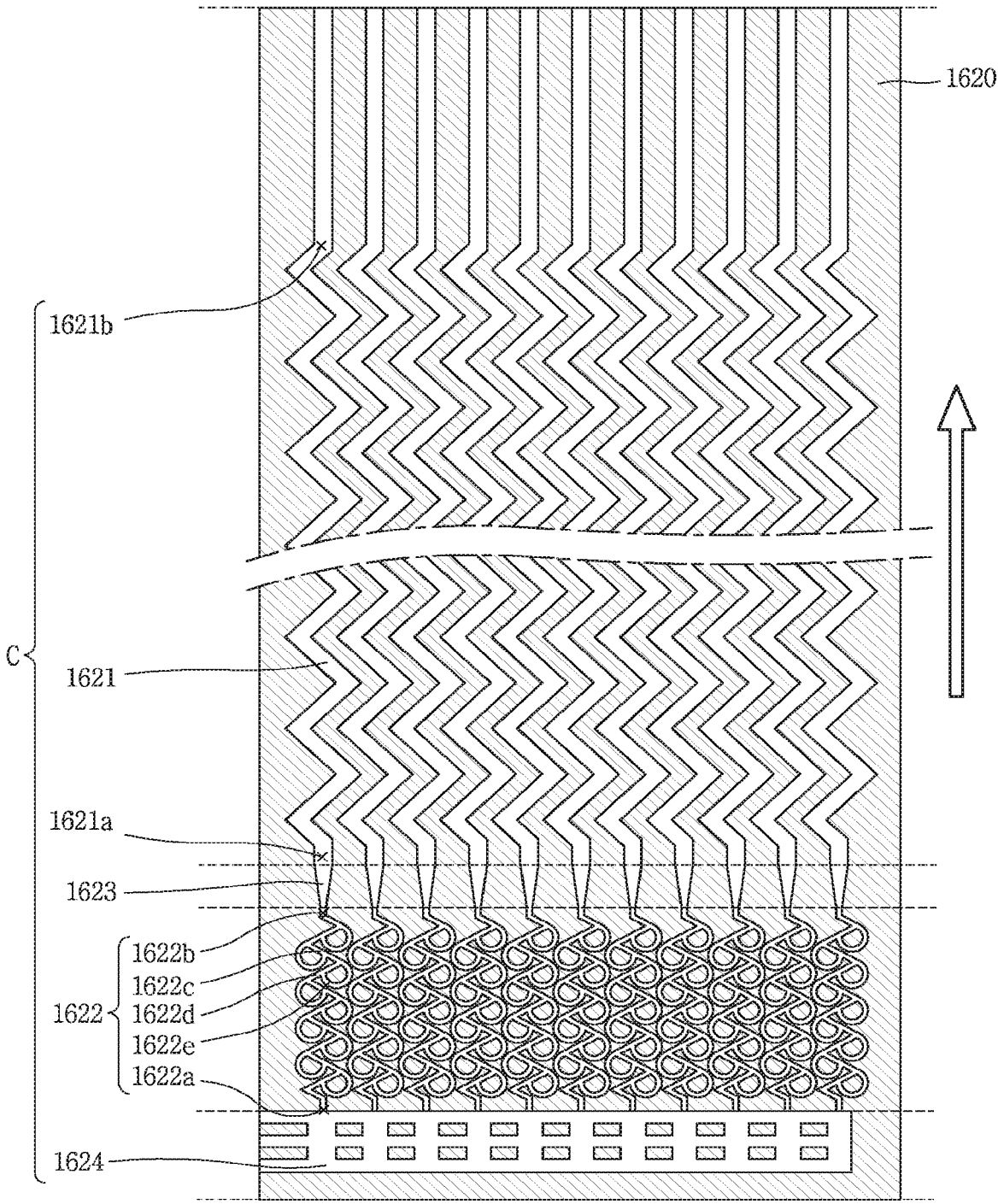

FIG. 12 illustrates an exemplary configuration according to the present invention which employs different flow path structures in a forward direction and a backward direction in order to increase backward flow resistance of the flow resistance section 1622, but the present invention may not be limited to this configuration.

Referring to FIG. 12, the flow resistance section 622 includes first tilt portions 1622*c* and second tilt portions 1622*d*. Here, the flow resistance section 1622 is configured such that a forward path coming from an inlet to an outlet has smaller flow resistance than a backward path coming from the outlet to the inlet. Accordingly, the backward flow resistance may be greater than the forward flow resistance.

To achieve this, a bypass portion 1622*e* is provided in which the backward path has greater flow resistance. The bypass portion 1622*e* connects one end of one of the tilt portions to a portion between both ends of the other tilt portion so as to be getting away from an outlet.

Figure 13A:
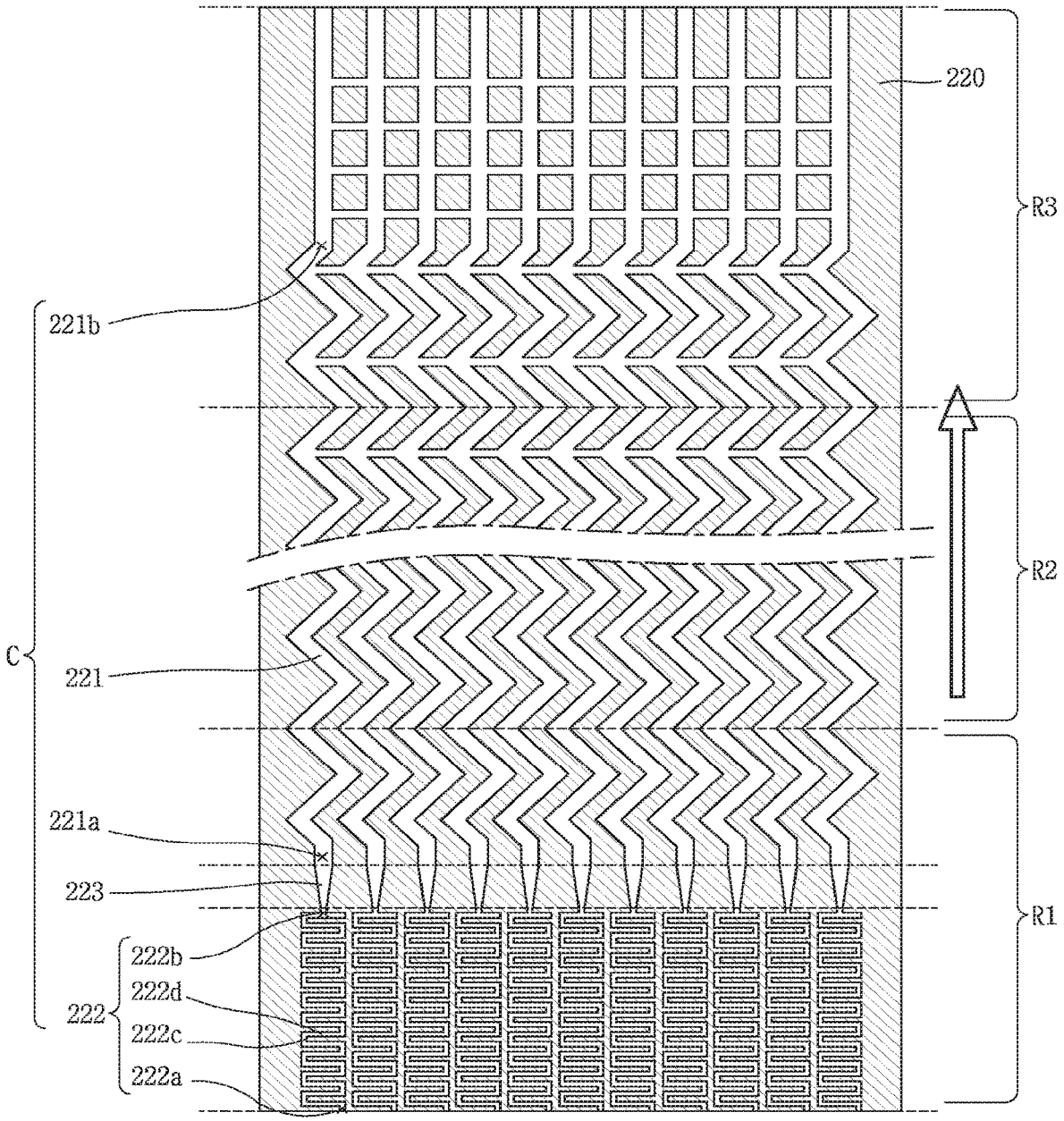
FIGS. 13A and 13B are conceptual views of channels formed on a second plate of a heat exchanger for a steam generator in accordance with another embodiment of the present invention.
Figure 13B:
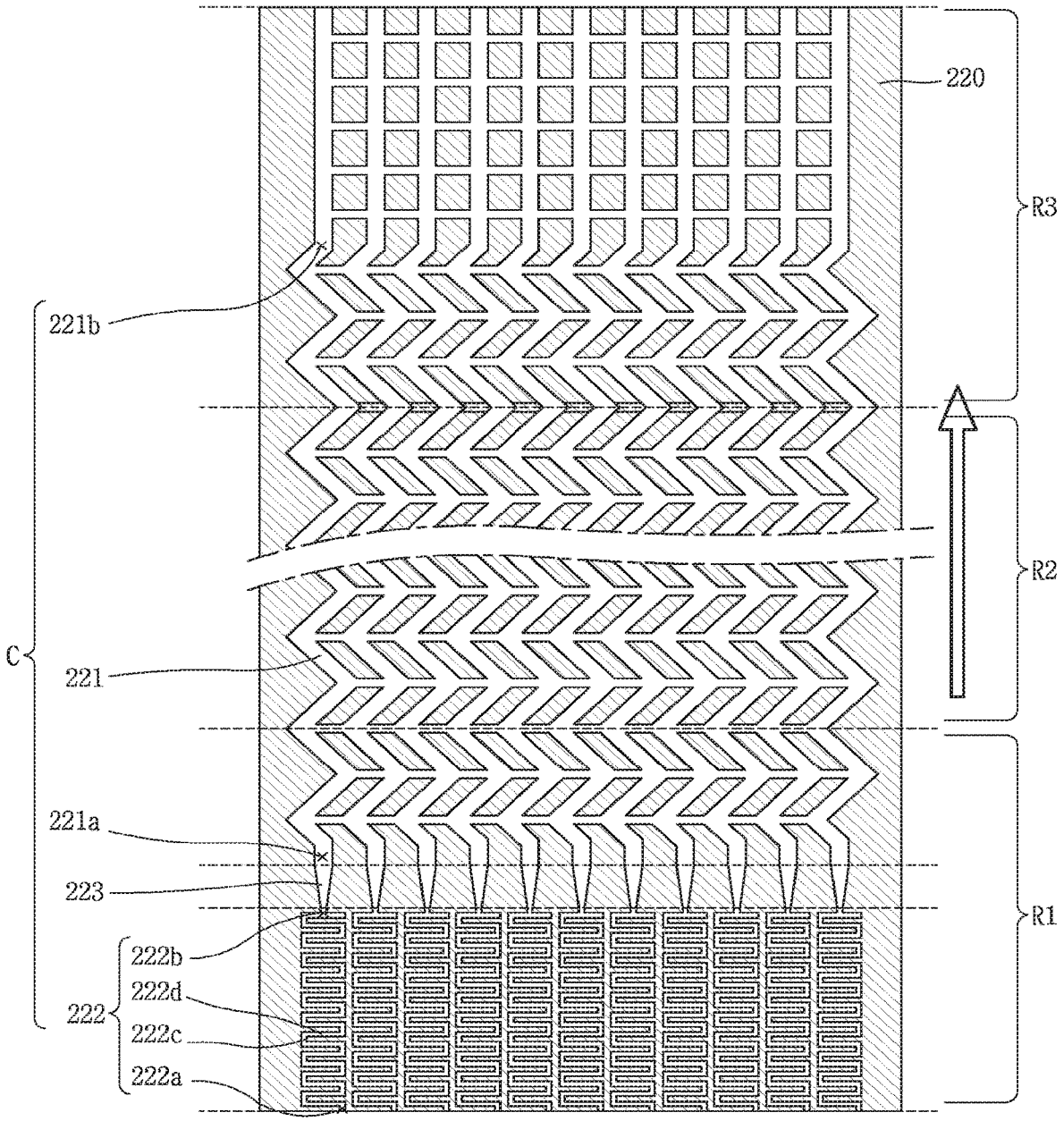

FIGS. 13A and 13B are conceptual views of channels C formed on a second plate of a heat exchanger for a steam generator in accordance in another exemplary embodiment of the present invention.

Referring to FIG. 13A, each of the channels C may be divided into a primary heat transmission section 221 and a flow resistance section 222. Each of the channels C of the primary heat transmission section 221 may be bent so as to extend longer than a distance between one side 221*a* and another side 221*b* (a length at which one side 221*a* and another side 221*b* are connected in a straight line). This may extend the length of each channel C than the straightly-connected length, which may increase the heat exchange area and improve heat exchanger efficiency accordingly.

The embodiment disclosed herein merely illustrates the bent shape, but the present invention may not be necessarily limited to the flow path in the bent shape because a similar effect can be obtained even in case of using a curved flow path.

The primary heat transmission section 221 may be divided into a first area R1 in which fluid in a liquid state exists, a second area R2 in which fluid in liquid and gaseous states exists, and a third area R3 in which fluid in a gaseous state exists.

The channels C of the second area R2 or the third area R3 may communicate with each other. In more detail, the channels C of the second area R2 adjacent to the third area R3 may communicate with each other. This may more facilitate the fluid in the gaseous state to flow along the channels C.

Each of the channels of the flow resistance section 222 may be configured to be narrower in width than the channel formed on the primary heat transmission section 221, and configured into a bent form so as to extend longer than a distance between an inlet 222*a* and an outlet 222*b* (a length at which an inlet 222*a* and an outlet 222*b* are connected in a straight line). The flow resistance section 222 may be connected to one side corresponding to an inlet of the primary heat transmission section 221. The flow resistance section 222 may form channels with a longer length and a smaller width at an inlet area of the heat exchanger, to generate great flow resistance, thereby reducing flow instability in each channel within a wide operation range. This may allow for a stable operation of the steam generator. This embodiment merely illustrates the bent shape, but the present invention may not be limited to the bent shape because a similar effect can be obtained even in case of using a curved flow path.

A flow path expanding section 223 may be formed between the flow resistance section 222 and the primary heat transmission section 221. The flow path expanding section 223 may be formed to have a gradually increasing width, so as to prevent the drastic change in a flow of coolant.

Still referring to FIG. 13A, the flow resistance section 222 includes first parts 212*c* and second parts 212*d*. The first parts 212*c* are portions extending in the first direction which is a direction connecting an inlet and an outlet, and the second parts 212*d* are portions extending in a second direction which intersects with the first direction. The first parts 212*c* and the second parts 212*d* may be formed in an alternating manner. One of the first and second parts 212*c* and 212*d* may be connected to an edge of the other. FIG. 13A illustrates an exemplary configuration in which some flow paths communicate with each other, but the present invention may not be necessarily limited to such configurations.

Also, referring to FIG. 13B, when most of the channels C of the primary heat transmission section 221 are configured to communicate with one another, the primary heat transmission section 221 may exhibit similar characteristics to an operation of a shell side of a shell and tube type heat exchanger. Therefore, the flow resistance section 222 serves as an economizer which enables a uniform distribution of a flow rate and improves heat transfer characteristics. FIG. 13B illustrates an exemplary configuration in which most channels of the primary heat transmission section 221 communicate with one another, but the present invention may not be necessarily limited to such configurations.

Figure 14:
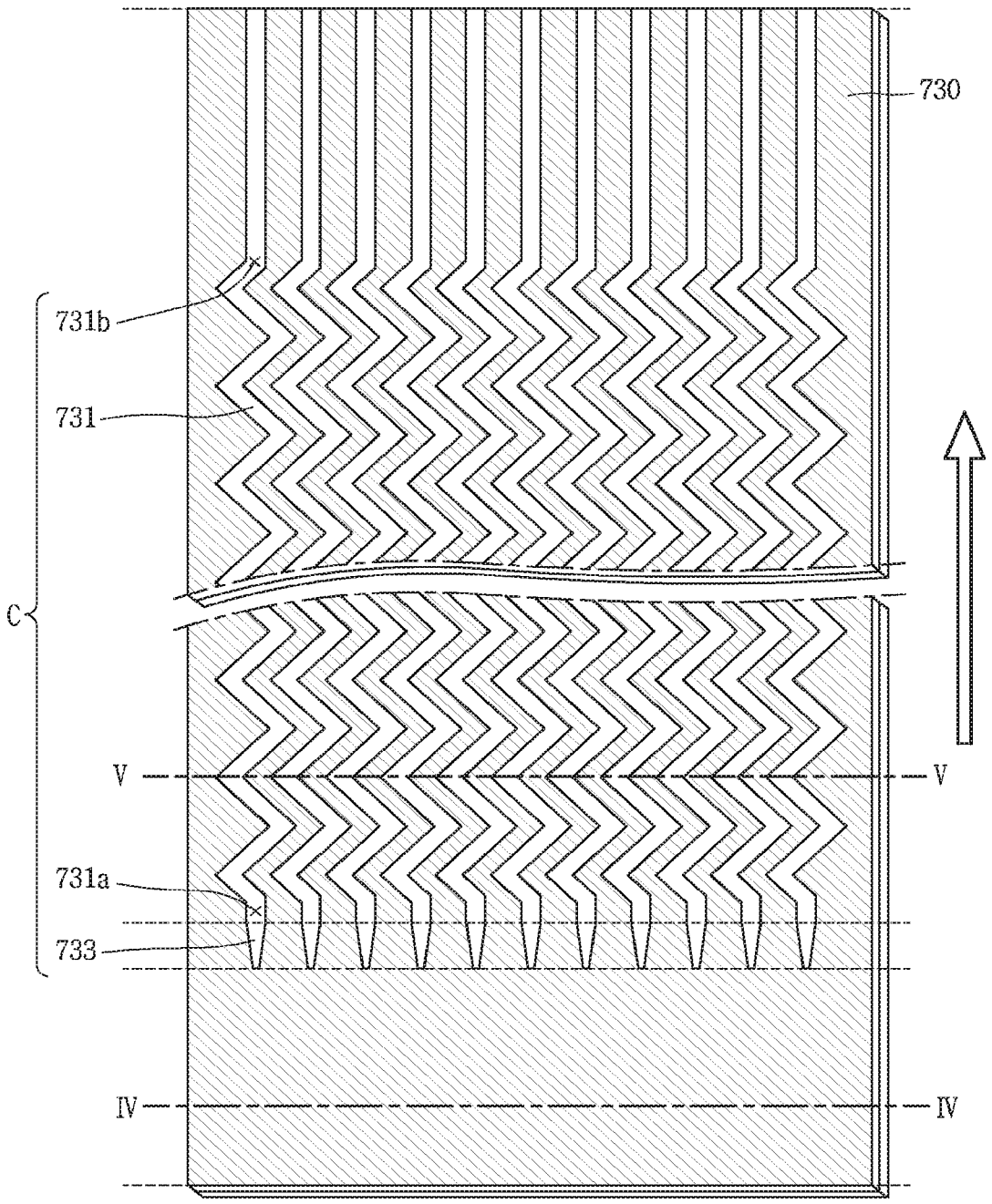
FIG. 14 is a conceptual view of channels formed on a third plate of a heat exchanger for a steam generator in accordance with another embodiment of the present invention.
Figure 15:
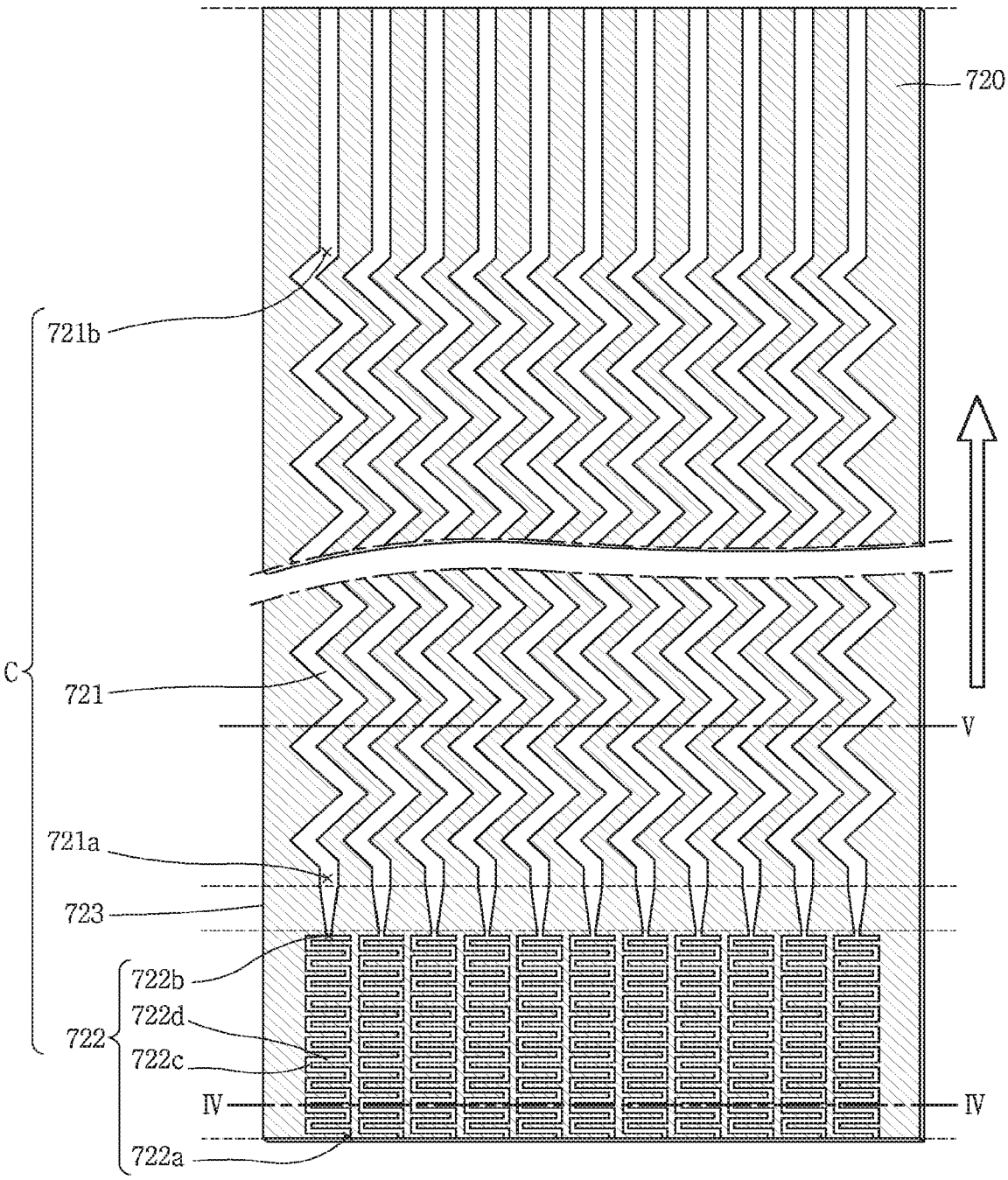
FIG. 15 is a conceptual view of channels formed on a second plate of a heat exchanger for a steam generator in accordance with another embodiment of the present invention.
Figure 16:
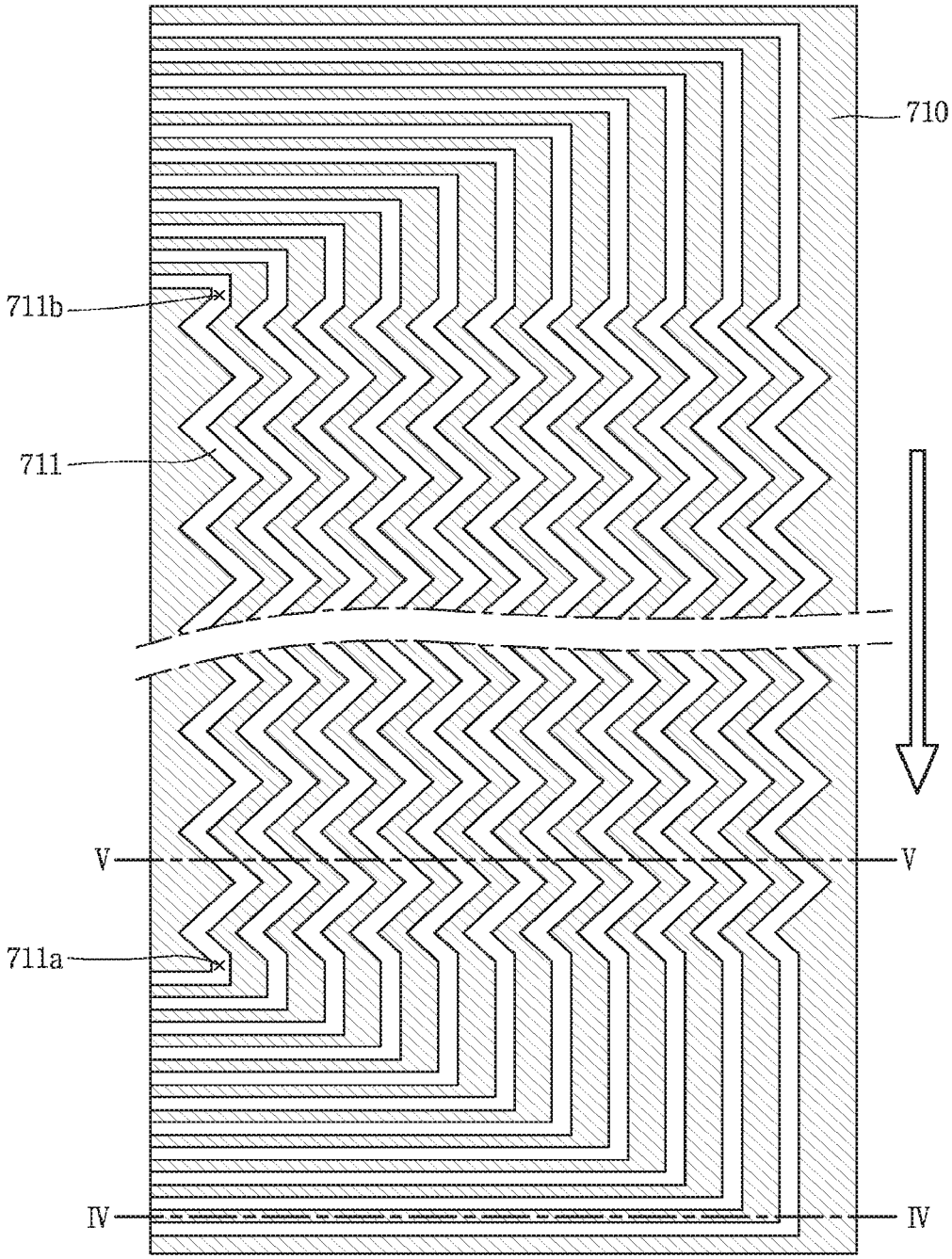
FIG. 16 is a conceptual view of channels formed on a first plate of a heat exchanger for a steam generator in accordance with another embodiment of the present invention.

FIG. 14 is a conceptual view of channels C formed on a third plate of a heat exchanger for a steam generator in accordance with another embodiment of the present invention, FIG. 15 is a conceptual view of channels C formed on a second plate of a heat exchanger for a steam generator in accordance with another embodiment of the present invention, and FIG. 16 is a conceptual view of channels C formed on the first plate of a heat exchanger for a steam generator in accordance with another embodiment of the present invention.

Figure 17:
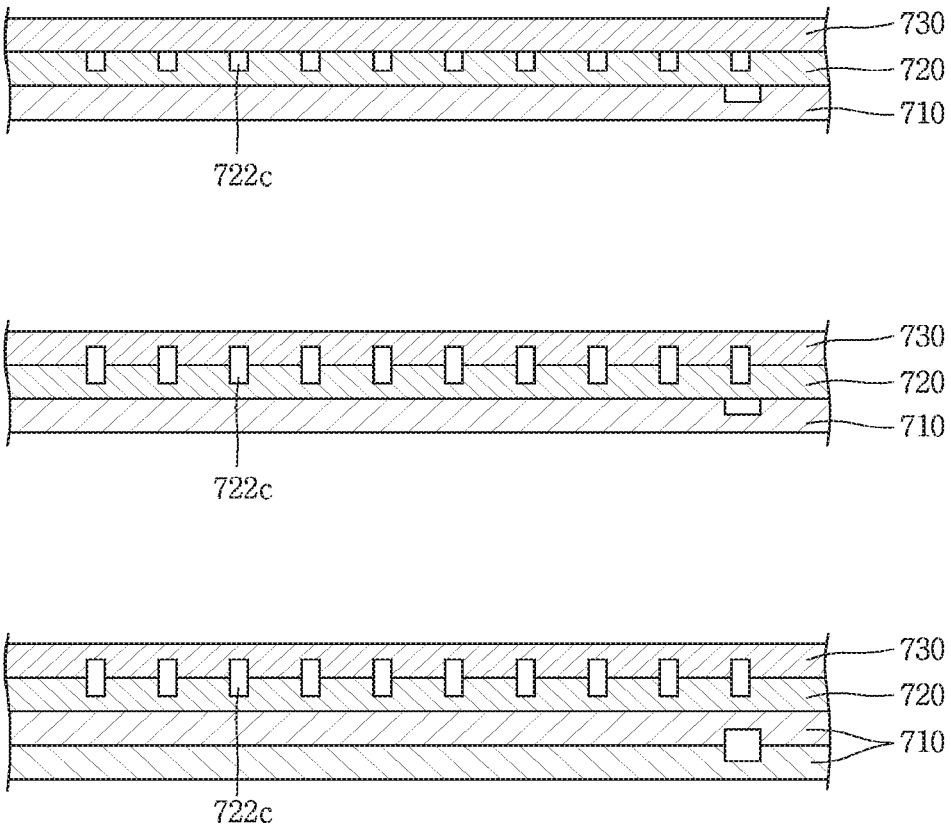
FIG. 17 is a cross-sectional view, taken along the line IV-IV of FIGS. 14 to 16.

And, FIG. 17 is a cross-sectional view, taken along the line IV-IV of FIGS. 14 to 16, and FIG. 18 is a cross-sectional view, taken along the line V-V of FIGS. 14 to 16.

As illustrated in FIGS. 14 to 18, the first to third plates 710, 720 and 730 are arranged in an overlaying manner. In more detail, the second plate 720 is disposed on the first plate 710, and the third plate 730 may be disposed on the second plate 720. Although not illustrated, at least one another plate may be disposed on the third plate 730, and a second fluid may flow along the plate disposed on the third plate 730.

While flowing along the first plate 710, a first fluid transfers heat to a second fluid which flows along the second and third plates 720 and 730. Phase transition of the second fluid from liquid to gas may occur due to the heat from the first fluid.

Figure 18:
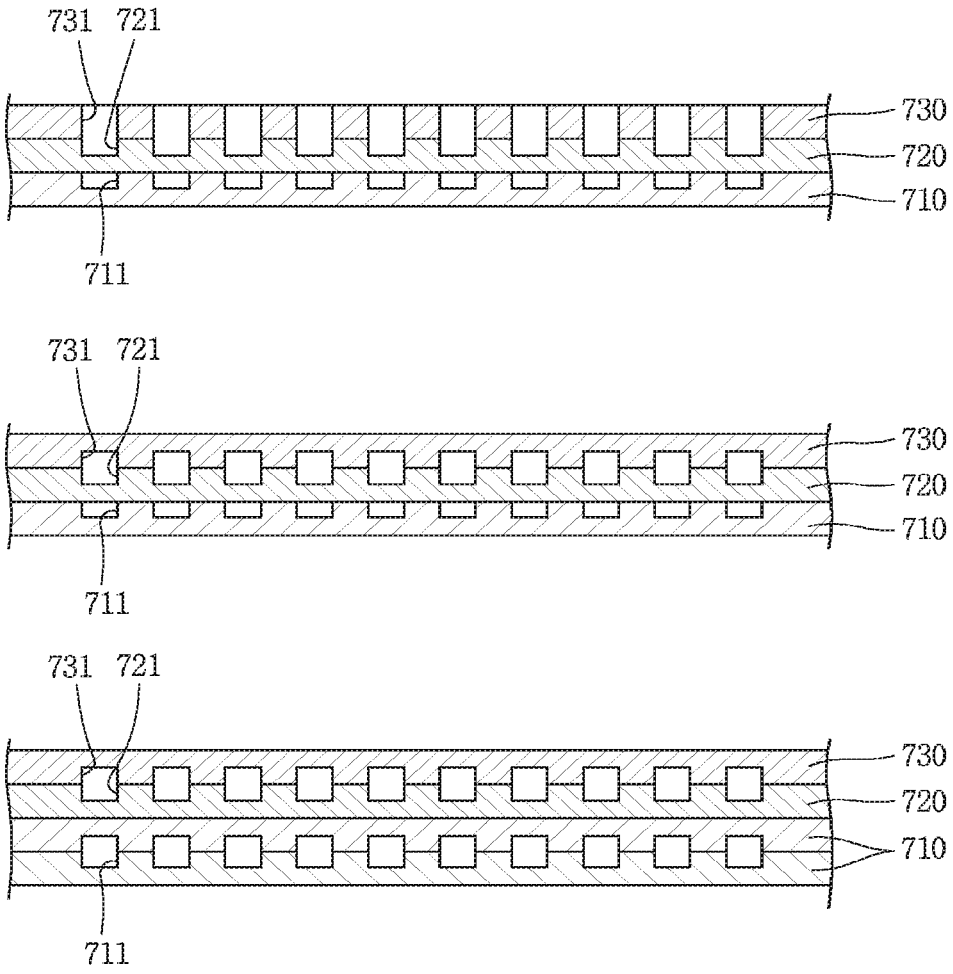
FIG. 18 is a cross-sectional view, taken along the line V-V of FIGS. 14 to 16.

In this instance, the second and third plates 720 and 730 may form one channel at a predetermined section. That is, as illustrated in FIG. 18, when the second plate 720 forms a lower portion of a channel, the third plate may form an upper portion of the channel. Here, the predetermined section may correspond to the primary heat transmission sections 721 and 731 of the channels C formed on the second and third plates 720 and 730, respectively.

Referring back to FIG. 15, each of the channels C of the second plate 720 may be divided into a primary heat transmission section 721 and a flow resistance section 722. The channel C of the primary heat transmission section 721 may be configured into a bent form so as to extend longer than a distance between one side 721*a* and another side 721*a* (a length at which one side 721*a* and another side 721*a* are connected in a straight line). This may extend the length of the channel C than the straightly-connected length, which may increase the heat exchange area and improve heat exchanger efficiency accordingly. The embodiment disclosed here has illustrated the bent shape, but the present invention may not be necessarily limited to the flow path in the bent shape because a similar effect can be obtained even in case of using a curved flow path.

Each of the channels C of the flow resistance section 722 is configured to be narrower in width than the channel formed on the primary heat transmission section 721, and configured into a bent form so as to extend longer than a distance between an inlet 722*a* and an outlet 722*b* (a length at which an inlet 722*a* and an outlet 722*b* are connected in a straight line). The flow resistance section 722 may be connected to one side corresponding to an inlet of the primary heat transmission section 721. The flow resistance section 722 may form channels with a longer length and a smaller width at an inlet area of the heat exchanger, to generate great flow resistance, thereby reducing flow instability in each channel within a wide operation range. This may allow for a stable operation of the steam generator. This embodiment merely illustrates the bent shape, but the present invention may not be limited to the bent shape because a similar effect can be obtained even in case of using a curved flow path.

A flow path expanding section 723 may be formed between the flow resistance section 722 and the primary heat transmission section 721. The flow path expanding section 723 may have a width which gradually increases, so as to prevent the drastic change in a flow of coolant.

Referring back to FIG. 14, each of the channels C of the third plate 730 may include only a primary heat transmission section 731 and a flow path expanding section 733, without a flow resistance section. This results from that the second and third plates 720 and 730 form the lower and upper portions of the channel, respectively. The flow resistance section 722 of the second plate 720 may be connected to the flow path expanding sections 723 and 733 of the second and third plates 720 and 730.

Referring back to FIG. 16, each of the channels formed on the first plate 710 includes the primary heat transmission section 711. Each channel of the primary heat transmission section 711 may be bent to extend longer than a distance between one side 711*a* and another side 711*b* (a length at which one side 711*a* and another side 711*b* are connected in a straight line). This may extend the length of each channel C than the straightly-connected length, which may increase a heat exchange area and improve heat exchanger efficiency accordingly. The embodiment disclosed here has illustrated the bent shape, but the present invention may not be necessarily limited to a flow path in a bent shape because a similar effect can be obtained even in case of using a curved flow path.

The plates illustrated in FIGS. 14 to 16 merely illustrate the embodiments constructing the plates of the heat exchanger. That is, as aforementioned with reference to FIGS. 3 to 13, a flow resistance section, a flow path expanding section or a common header may be formed on a plate according to design conditions of the heat exchanger.

Figure 19:
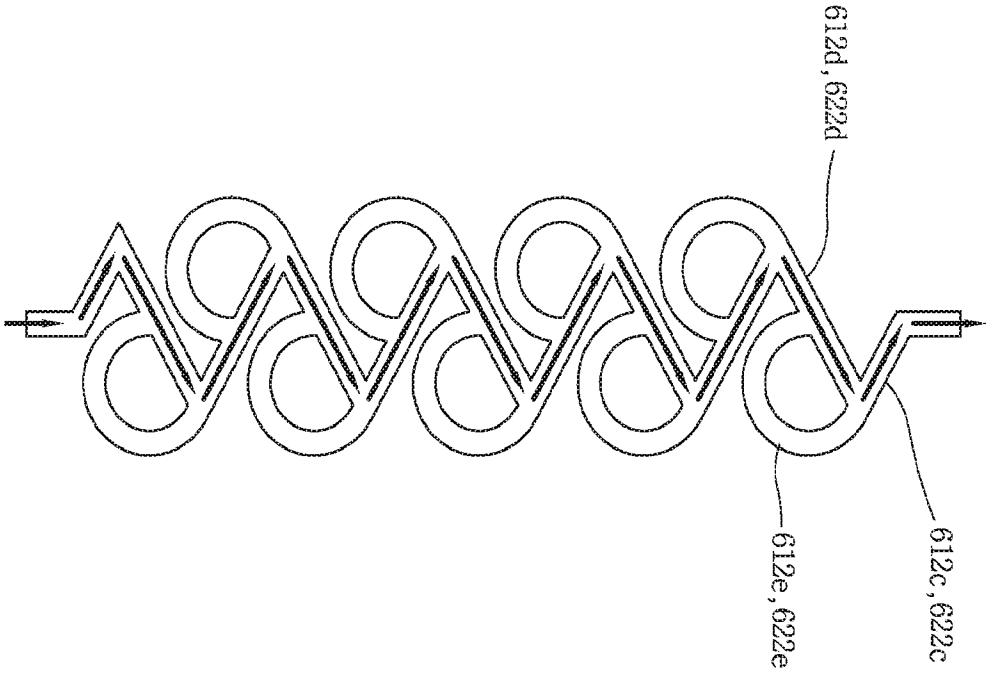
FIGS. 19 and 20 are conceptual views illustrating a flow of fluid in a flow resistance section illustrated in FIGS. 7 and 12, respectively.
Figure 20:
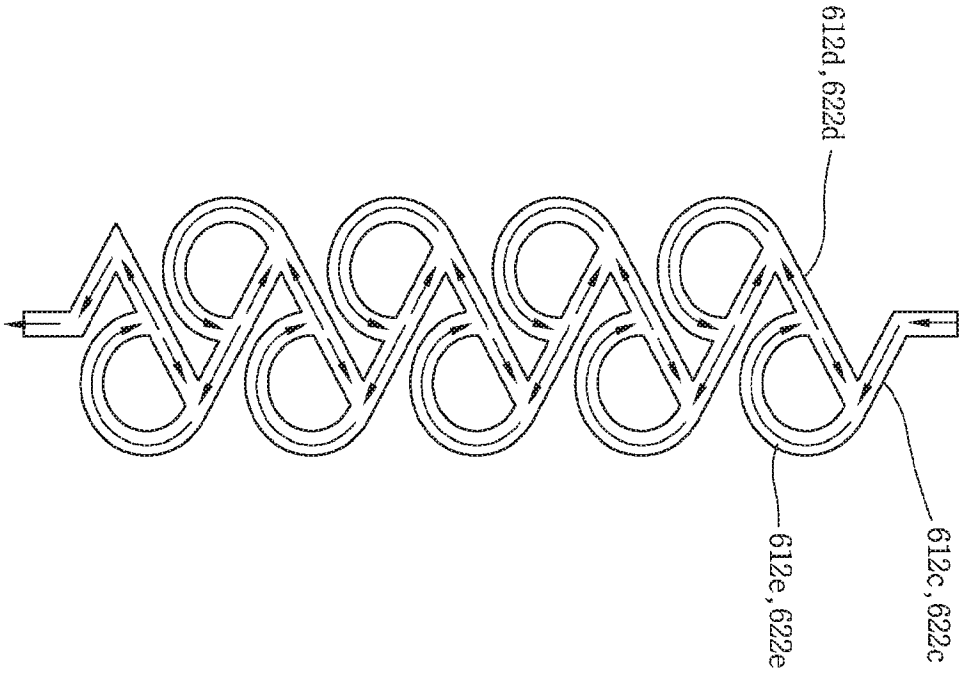

FIGS. 19 and 20 are conceptual views illustrating fluid flows inside a flow resistance section illustrated in FIGS. 7 and 12, respectively. As illustrated, the flow resistance section 612, 622 includes first tilt portions 612*c*, 622*c* and second tilt portions 612*d*, 622*d*. Here, the flow resistance section 612, 622 is configured such that a forward path coming from an inlet to an outlet exhibits smaller flow resistance than a backward path coming from the outlet to the inlet and a forward flow exhibits a smoother change than a backward flow. Accordingly, the backward flow resistance may be greater than the forward flow resistance.

To achieve this, bypass portion 612*e*, 622*e* with great flow resistances is provided, which results from extended backward path and interference between flowing directions intersecting with each. The bypass portion 612*e*, 622*e* is configured in a manner that connects one end of one of the tilt portions to a portion between both ends of the other tilt portion so as to be getting away from an outlet.

Fluid flows along the first tilt portion 612*c*, 622*c* and the second tilt portion 612*d*, 622*d* in the forward direction, whereas flowing along the first tilt portion 612*c*, 622*c* and then flowing toward a middle point of the second tilt portion 612*d*, 622*d* via the bypass portion 612*e*, 622*e* in the backward direction. Accordingly, the backward path may become longer than the forward path and flowing directions of the backward and forward paths may cross each other to cause interference therebetween. This may result in more increased backward flow resistance than forward flow resistance.

The aforementioned heat exchanger for the steam generator may not be necessarily limited to the configurations and methods of the foregoing embodiments, but a part or all of the embodiments can be selectively combined to derive many variations.

[Industrial Availability]

The heat exchanger for the steam generator according to the present invention may not be limited applied to the configurations and methods of the aforementioned embodiments, but a part or all of the embodiments can be selectively combined to derive various modifications.

The invention claimed is:

1. A heat exchanger for a steam generator, the heat exchanger comprising:

a plate; and channels formed on the plate, wherein each of the channels comprises:

a primary heat transmission section including a bent or curved flow path to extend longer than a distance between one side and another side; and a flow resistance section formed having a smaller width than the width of the channels formed on the primary heat transmission section, and connected to one side of the primary heat transmission section in a manner of having a bent or curved flow path to extend longer than a distance between an inlet and an outlet, wherein a common header extends from an edge of the plate to the inlet of each of the flow resistance sections to distribute fluid into each of the channels, wherein the common header extends in a direction intersecting with a direction from the inlet to the outlet of the flow resistance section, and wherein the common header comprises:

a first section extending in a first direction intersecting with a direction from the inlet to the outlet of the flow resistance section; and a second section extending in a second direction parallel to the direction from the inlet to the outlet of the flow resistance section, wherein the first section and the second section are configured to intersect each other, wherein the first section and the second section are provided in plural, the plurality of the first sections are formed at positions spaced apart from each other in the second direction, and the plurality of the second sections are formed at positions spaced apart from each other in the first direction, and wherein, the lengths of the plurality of first section formed at positions spaced apart from each other are the same, and the lengths of the plurality of second section formed at positions spaced apart from each other are the same.

2. The heat exchanger of claim 1, wherein each of the channels includes a flow path expanding section formed between the flow resistance section and the primary heat transmission section in a manner of having a gradually increasing width.

3. The heat exchanger of claim 1, wherein the flow resistance section comprises:

first parts extending in a first direction as a direction connecting the inlet and the outlet to each other; and second parts extending in a second direction intersecting with the first direction, wherein the first and second parts are formed in an alternating manner.

4. The heat exchanger of claim 1, wherein the primary heat transmission section comprises:

a first area in which fluid in a liquid state exists;

a second area in which fluid in liquid and gaseous states exists; and a third area in which fluid in a gaseous state exists, wherein at least one of channels of the first to third areas is connected in a communicating manner.

5. The heat exchanger of claim 4, wherein the flow resistance section serves as an economizer that uniformizes a flow rate of an inlet of the heat exchanger and increases heat exchange efficiency at a single-phase area.

6. The heat exchanger of claim 1, wherein the plate is provided with channels formed by a photo-chemical etching method or in a pressing manner.

7. A steam generator comprising the heat exchanger according to claim 1.

* * * * *